US009377752B2

(12) United States Patent
Komatsu et al.

(10) Patent No.: US 9,377,752 B2
(45) Date of Patent: Jun. 28, 2016

(54) IMAGE FORMING APPARATUS WITH IMAGE BEARING MEMBER PROTECTION

(71) Applicant: CANON KABUSHIKI KAISHA, Tokyo (JP)

(72) Inventors: Noriyuki Komatsu, Numazu (JP); Tetsuya Numata, Suntou-gun (JP); Osamu Anan, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/732,882

(22) Filed: Jun. 8, 2015

(65) Prior Publication Data

US 2015/0362890 A1 Dec. 17, 2015

(30) Foreign Application Priority Data

Jun. 16, 2014 (JP) ..... 2014-123276

(51) Int. Cl.
*G03G 21/16* (2006.01)

(52) U.S. Cl.
CPC ..... *G03G 21/1676* (2013.01)

(58) Field of Classification Search
CPC ..... G03G 21/1676; G03G 21/1846; G03G 21/1839; G03G 2221/163; G03G 2221/1778; G03G 2221/1869
See application file for complete search history.

(56) References Cited

U.S. PATENT DOCUMENTS 8,768,211 B2 7/2014 Hayashi et al.
9,026,001 B2 5/2015 Numata et al.
2007/0160386 A1* 7/2007 Kawamura ..... G03G 21/1825 399/110
2007/0160388 A1* 7/2007 Yoshimura ..... G03G 21/1825 399/111
2009/0317133 A1* 12/2009 Nishimura ..... G03G 15/0865 399/119
2010/0080615 A1* 4/2010 Kikuchi ..... G03G 21/16 399/111
2010/0080622 A1* 4/2010 Uchida ..... G03G 21/1839 399/117
2010/0166457 A1* 7/2010 Hashimoto ..... G03G 15/0813 399/117

(Continued)

FOREIGN PATENT DOCUMENTS

JP 2001-337580 A 12/2001

OTHER PUBLICATIONS

Ryuta Murakami, et al., U.S. Appl. No. 14/730,532, filed Jun. 4, 2015.

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image forming apparatus includes an image bearing member, a developer carrying member, and a moving member movable between an inside position inside of a main body of the image forming apparatus and an outside position outside of the main body in a state of supporting the image bearing member and the developer carrying member. A protection member is provided on the moving member and protects a surface of the image bearing member. In addition, a holding mechanism holds the protection member at a first position at which the protection member protrudes above a portion of the image bearing member exposed at an exposing portion when the moving member is located at the outside position and holds the protection member at a second position at which the protection member is located below a transfer member when the moving member is located at the inside position.

28 Claims, 26 Drawing Sheets

(56) References Cited

U.S. PATENT DOCUMENTS

2011/0026966 A1* 2/2011 Ushiozu ..... G03G 21/1832 399/110
2011/0033201 A1* 2/2011 Akutsu ..... G03G 21/1853 399/110
2011/0116833 A1* 5/2011 Maeda ..... G03G 15/0178 399/112
2011/0280616 A1* 11/2011 Itabashi ..... G03G 21/1623 399/110
2011/0299881 A1* 12/2011 Tateishi ..... G03G 21/1846 399/110
2012/0027422 A1* 2/2012 Itabashi ..... G03G 15/0886 399/12
2012/0195627 A1* 8/2012 Kikuchi ..... G03G 21/1647 399/110
2013/0028631 A1* 1/2013 Sato ..... G03G 15/0126 399/110
2013/0108316 A1* 5/2013 Sato ..... G03G 15/0216 399/110
2014/0086630 A1* 3/2014 Kitajima ..... G03G 21/1839 399/111
2015/0241840 A1* 8/2015 Kikuchi ..... G03G 21/1676 399/119

* cited by examiner

IMAGE FORMING APPARATUS WITH IMAGE BEARING MEMBER PROTECTION

BACKGROUND OF THE INVENTION

1. Field of the Invention

The present invention relates to an image forming apparatus. More particularly, the present invention relates to an image forming apparatus suited for use as a copying machine, a printer (such as LED printer and laser beam printer), a facsimile machine, a word processor, and the like that are configured to form images on recording media by using an electrophotographic image forming process.

2. Description of the Related Art

Hitherto, in an image forming apparatus using an electrophotographic image forming process, there has been known an integrated cartridge system in which drums as photosensitive members (image bearing members) and developing units each housing a developing roller to act on the corresponding drum and each containing developer (toner) to be used for image formation are integrated with each other. Further, there have also been known a developing cartridge system in which the cartridge has only the developing units independently of the drums, and a drum cartridge system in which the cartridge has only the drums and process components to act on the corresponding drums. Those cartridge systems allow users themselves to perform maintenance of the apparatus without service engineers. Thus, those cartridge systems have been widely used in electrophotographic image forming apparatus.

Further, there has also been known a technology of arranging a support member to which integrated cartridges, developing cartridges, or drum cartridges are mounted, and pulling out the support member from an inside of a main body of the electrophotographic image forming apparatus to a predetermined position so that an operation of replacing various types of cartridges can be performed. The technology allows the users to easily replace the various types of cartridges.

As another example of the main body constructed as described above, there has been known a configuration in which shutter members are provided respectively on the cartridges, and the shutter members are moved to positions of protecting the corresponding drums (image bearing members) when the support member is pulled out, and to opening positions when the support member is located at a mounting position in the main body (Japanese Patent Application Laid-Open No. 2001-337580).

However, in such related art, the shutter members provided on the cartridges cause an increase in cost of the consumable cartridges, or an increase in size of the cartridges.

SUMMARY OF THE INVENTION

The present invention provides an image forming apparatus configured to suppress an increase in cost or size of cartridges.

According to a representative embodiment of the present application, there is disclosed an image forming apparatus, comprising: an image bearing member; a developer carrying member configured to form a developer image on the image bearing member; a moving member movable between an inside position located inside of a main body of the image forming apparatus and an outside position located outside of the main body in a state of supporting the image bearing member and the developer carrying member and exposing the image bearing member vertically upward, the moving member comprising a mounting portion on which a cartridge is mounted, the cartridge being mountable on and removable from the mounting portion when the moving member is located at the outside position; a protection member provided on the moving member and configured to protect a surface of the image bearing member; and a holding mechanism configured to hold the protection member at an upper position vertically above the surface of the image bearing member when the moving member is moved between the inside position and the outside position, and to hold the protection member at a lower position vertically below the surface of the image bearing member at a time of an image formation when the moving member is located at the inside position.

Further features of the present invention will become apparent from the following description of exemplary embodiments with reference to the attached drawings.

DESCRIPTION OF THE EMBODIMENTS

Figure 1:
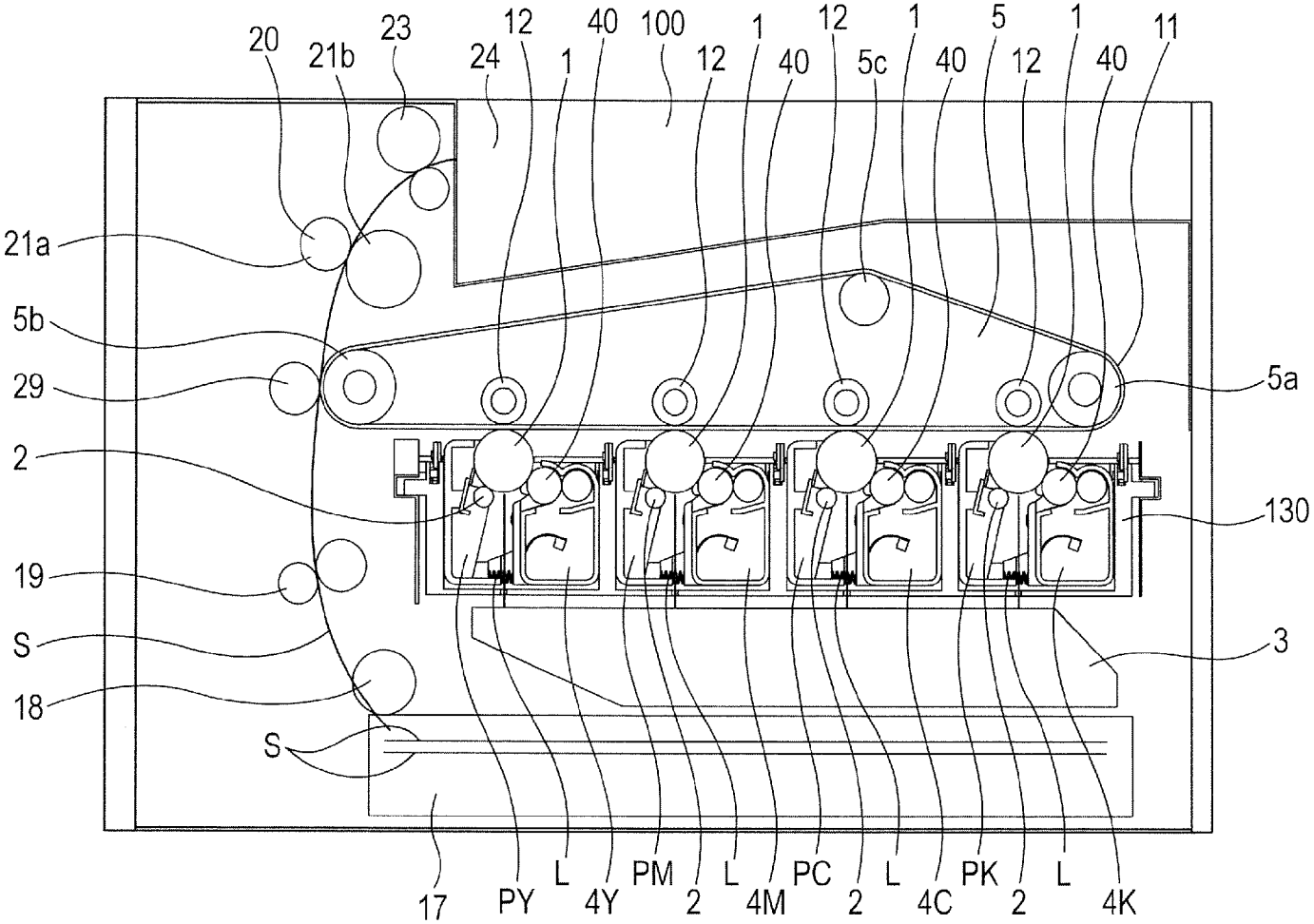
FIG. 1 is a sectional view for illustrating a main body of an image forming apparatus according to a first embodiment.

Now, exemplary embodiments of the present invention will be described in detail with reference to the accompanying drawings.

First Embodiment (Image Forming Apparatus)

Referring to FIG. 1, FIG. 2A, FIG. 2B, and FIG. 6, an overall structure of an image forming apparatus using an electrophotographic image forming process according to a first embodiment of the present invention will be described. In a main body of the image forming apparatus according to the embodiment (hereinafter referred to as "main body 100"), four electrophotographic photosensitive members as image bearing members (hereinafter referred to as "drums 1") are arrayed in a horizontal direction. Further, in the main body 100, charging units 2, an exposure unit 3, developing units 4Y, 4M, 4C, and 4K, and an electrostatic transfer unit (hereinafter referred to as "transfer member 5") are provided as electrophotographic image forming process devices in addition to the drums 1.

The "developing units 4Y, 4M, 4C, and 4K (the suffixes Y, M, C, and K mean that the developing units 4Y, 4M, 4C, and 4K contain yellow, magenta, cyan, and black developers, respectively)" are hereinafter referred to as "developing units 4" through abbreviation of the suffixes indicating the respective colors for convenience.

Note that, the charging units 2 each have a function to uniformly charge a surface of corresponding one of the drums 1. Further, the exposure unit 3 is configured to radiate laser beams L onto the drums 1 in accordance with image information so that electrostatic latent images are formed on the surfaces of the drums 1. Meanwhile, the developing units 4 each have a function to develop the electrostatic latent image, which is formed on the surface of corresponding one of the drums 1, by using toner as developer. The transfer member 5 has a function to transfer toner images on the drums 1 onto a sheet material S as a transferred member, that is, a recording medium (recording material). Specific examples of the sheet material S include a paper sheet and an OHP sheet.

The drum 1 is obtained by, for example, applying an organic photoconductor layer (OPC photosensitive member) to an outer peripheral surface of an aluminum cylinder. Both end portions of the drum 1 are supported in a freely rotatable manner by a support member (not shown). Further, a drum coupling member (not shown) configured to receive a driving force from a drive motor (not shown) is provided at one of the end portions. With this, the drum 1 receives the driving force transmitted from the drive motor through intermediation of the drum coupling member, and is thereby rotated in a counterclockwise direction in FIG. 1 (direction indicated by the arrow A in FIG. 6).

The charging unit 2 according to the embodiment employs a contact charging type. More specifically, the charging unit 2 comprises a conductive roller (a charging roller) formed into a roller shape, and the charging unit 2 abuts against the surface of the drum 1. Then, a charging bias voltage is applied to the charging unit 2 so that the surface of the drum 1 is uniformly charged.

The exposure unit 3 is provided vertically below the drums 1. The exposure unit 3 radiates the laser beams L correspondingly to image signals to expose the charged surfaces of the drums 1. With this, the electrostatic latent images corresponding to the image signals are formed on the surfaces of the drums 1.

The developing units 4 respectively include toner containers 41 (see FIG. 6) that respectively contain toners of yellow, magenta, cyan, and black (hereinafter represented by yellow: Y, magenta: M, cyan: C, and black: K). Note that, those toner containers 41 serve as developer containing portions configured to contain developers (toners) to be supplied to developing rollers 40. The toners in those toner containers 41 are supplied to toner supply rollers 43. Then, the toner supply roller 43 and a developing blade 44 that is held in press-contact with an outer periphery of the developing roller 40 as a developer carrying member cause the toner to be applied to the outer periphery of the developing roller 40 and to be electrically charged.

Then, a developing bias is applied to the developing roller 40 so that the toner adheres to the latent image formed on the drum 1. With this, the toner image is formed. Note that, the developing roller 40 is provided so as to face and come into contact with the drum 1. The developing unit 4 and the drum 1 integrally form each of process cartridges P (PY, PM, PC, and PK) (hereinafter referred to as "cartridges P"). When the toner is consumed through use by users and the cartridge P reaches its end of life, the cartridge P as a whole can be replaced.

As illustrated in FIG. 1, the main body 100 includes an intermediate transfer belt (hereinafter referred to as a transfer belt) 11 that is held in contact with the drums 1. The transfer belt 11 causes the toner images formed on the surfaces of the drums 1 to be transferred onto the sheet material S, which has been conveyed to a transfer position, by the transfer belt 11.

The transfer belt 11 of the transfer member 5 is stretched around a roller 5*a*, a roller 5*b*, and a roller 5*c*. In addition, in an inside of the transfer belt 11, transfer rollers 12 as primary transfer rollers are provided at positions respectively facing the drums 1. A voltage having a polarity reverse to that of the toners is applied to each of the transfer rollers 12 so that the toner images on the drums 1 are transferred onto the transfer belt 11.

Further, the main body 100 includes a feed roller 18 having a function to feed the sheet material S to an image forming portion. The feed roller 18 is provided above a feeding cassette 17 configured to contain a plurality of sheet materials S. During the image formation, the feed roller 18 and a registration roller pair 19 are rotated in response to an image forming operation. With this, the sheet materials S in the feeding cassette 17 are fed one by one. In synchronization with a rotation of the transfer belt 11 and the toner images, the sheet material S is fed to the transfer belt 11 by the registration roller pair 19.

Then, the sheet material S passes between the transfer belt 11 and an opposed transfer roller 29 as a secondary transfer roller. A voltage having a polarity reverse to that of the toners is applied to the transfer roller 29 so that the toner images on the transfer belt 11 are transferred onto the sheet material S.

Further, the main body 100 includes a fixing portion 20 having a function to fix the plurality of colors of the toner images transferred onto the sheet material S. The fixing portion 20 includes a rotatable heating roller 21*b* and a pressure roller 21*a* that is held in press-contact therewith. Specifically, the sheet material S having the toner images transferred thereonto from the transfer belt is conveyed while being nipped between the heating roller 21*b* and the pressure roller 21*a* so as to be heated and pressurized. With this, the images of the plurality of colors are fixed onto the surface of the sheet material S.

The image forming process can be summarized as follows. When the image forming operation is started, the drums 1 are rotated. Then, the charging units 2 electrically charge the surfaces of the drums 1, and the exposure unit 3 performs the exposure on the surfaces of the drums in accordance with the image signals. With this, the electrostatic latent images are formed on the surfaces of the drums 1. Next, those electrostatic latent images are developed (toners are caused to adhere thereto) by the developing rollers 40. The toner images formed on the surfaces of the drums 1 are sequentially transferred onto the transfer belt 11 by electric fields generated between the drums 1 and the transfer rollers 12.

Meanwhile, the sheet material S fed by the feed roller 18 is conveyed while being nipped between the transfer belt 11 and the opposed transfer roller 29. The voltage applied to the transfer roller 29 has the polarity reverse to that of the toners. Thus, the toner images formed on a surface of the transfer belt 11 are transferred onto the sheet material S by an electric field generated between the transfer belt 11 and the transfer roller 29. Then, the sheet material S is fed to the fixing portion 20. In the fixing portion 20, the color images are fixed onto the sheet material S, and the sheet material S is delivered to an outside of the main body 100 through a delivery portion 24 by a delivery roller pair 23.

(Pullout Member (Moving Member))

Next, referring to FIG. 2A and FIG. 2B, a pullout member 130 that doubles as a support member configured to support the cartridges P and a moving member configured to be movable between a mounting position (inside position) located inside of the main body 100 and a pullout position (outside position) located outside of the main body 100 will be described.

Figure 2A:
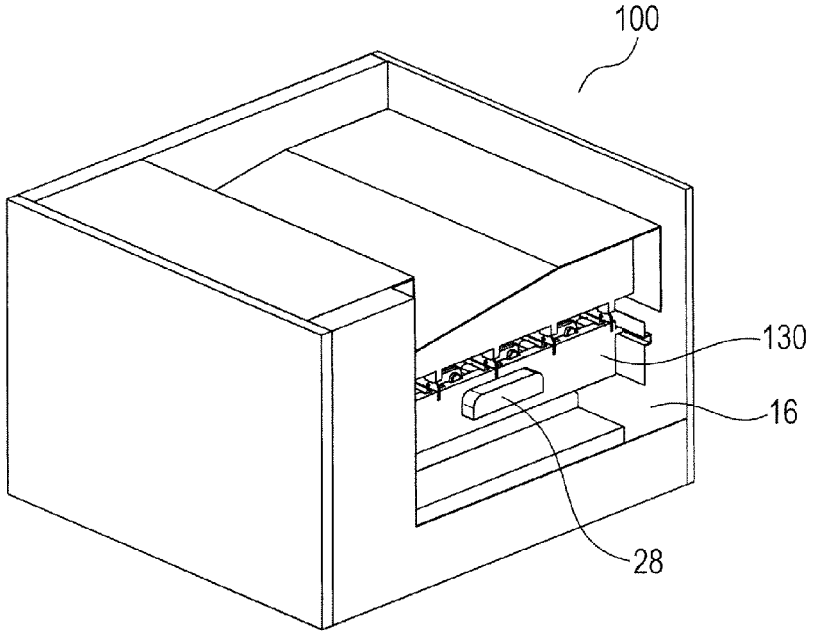
FIGS. 2A and 2B are each a perspective view for illustrating the main body according to the first embodiment.
Figure 2B:
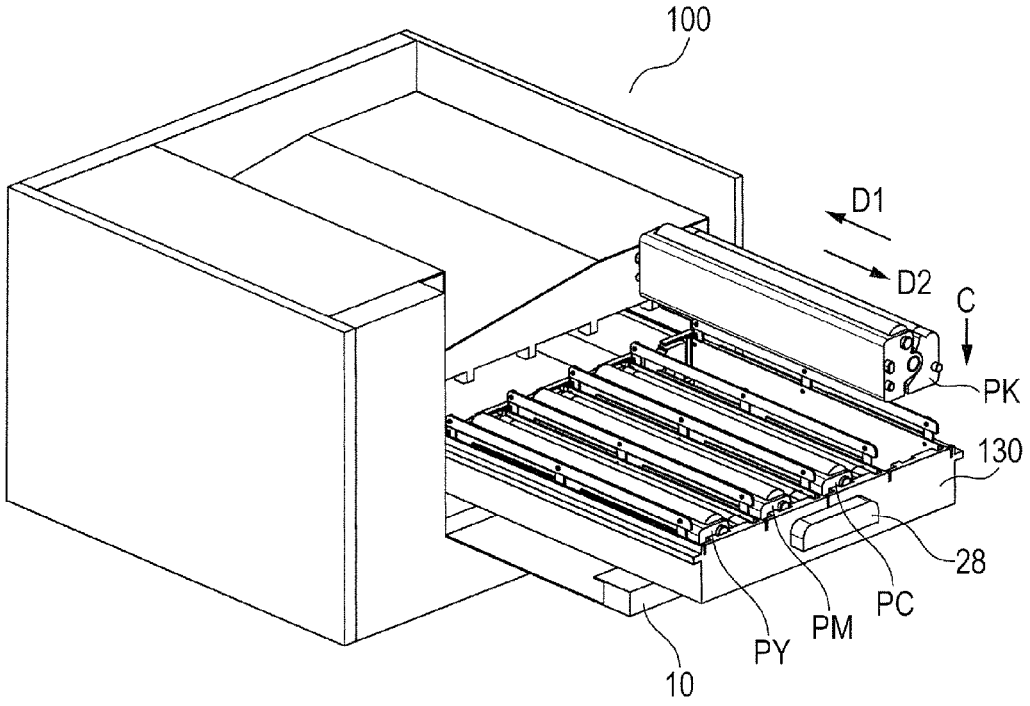

As illustrated in FIG. 2A and FIG. 2B, by opening a door 10 of the main body 100, the pullout member 130 can be pulled out through an opening 16 in a direction orthogonal to a conveying direction of the sheet material S. The pullout member 130 can be linearly moved with respect to (pushed into or pulled out of) the main body 100 substantially in the horizontal direction (directions indicated by the arrows D1 and D2). In addition, the pullout member 130 is movable between the mounting position (inside position illustrated in FIG. 2A) at which the pullout member 130 is located in the inside of the main body 100 and the pullout position (outside position illustrated in FIG. 2B) at which the pullout member 130 is pulled out of the main body 100.

Then, as illustrated in FIG. 2B, in the state in which the pullout member 130 is located at the pullout position, the cartridge PK (black) is mounted into the pullout member 130 substantially in a gravity direction (vertical direction indicated by the arrow C in FIG. 2B) by the user. The cartridge PK mounted in this way is provided so that a longitudinal direction thereof (axial direction of the drum 1) is parallel to a moving direction of the pullout member 130. Note that, the other three cartridges PY, PM, and PC are similarly mountable. The four cartridges PY, PM, PC, and PK are arranged in an arrangement direction orthogonal to the moving direction of the pullout member 130.

The cartridges P (PY, PM, PC, and PK) mountable on and removable from the pullout member 130 are moved into the main body 100 together with the pullout member 130 in a state of being mounted into the pullout member 130. Then, when the door 10 is closed in the state in which the pullout member 130 is moved into the main body 100, all the cartridges P are positioned to predetermined positions in the main body 100.

(Mounting Portion of Main Body)

Figure 3:
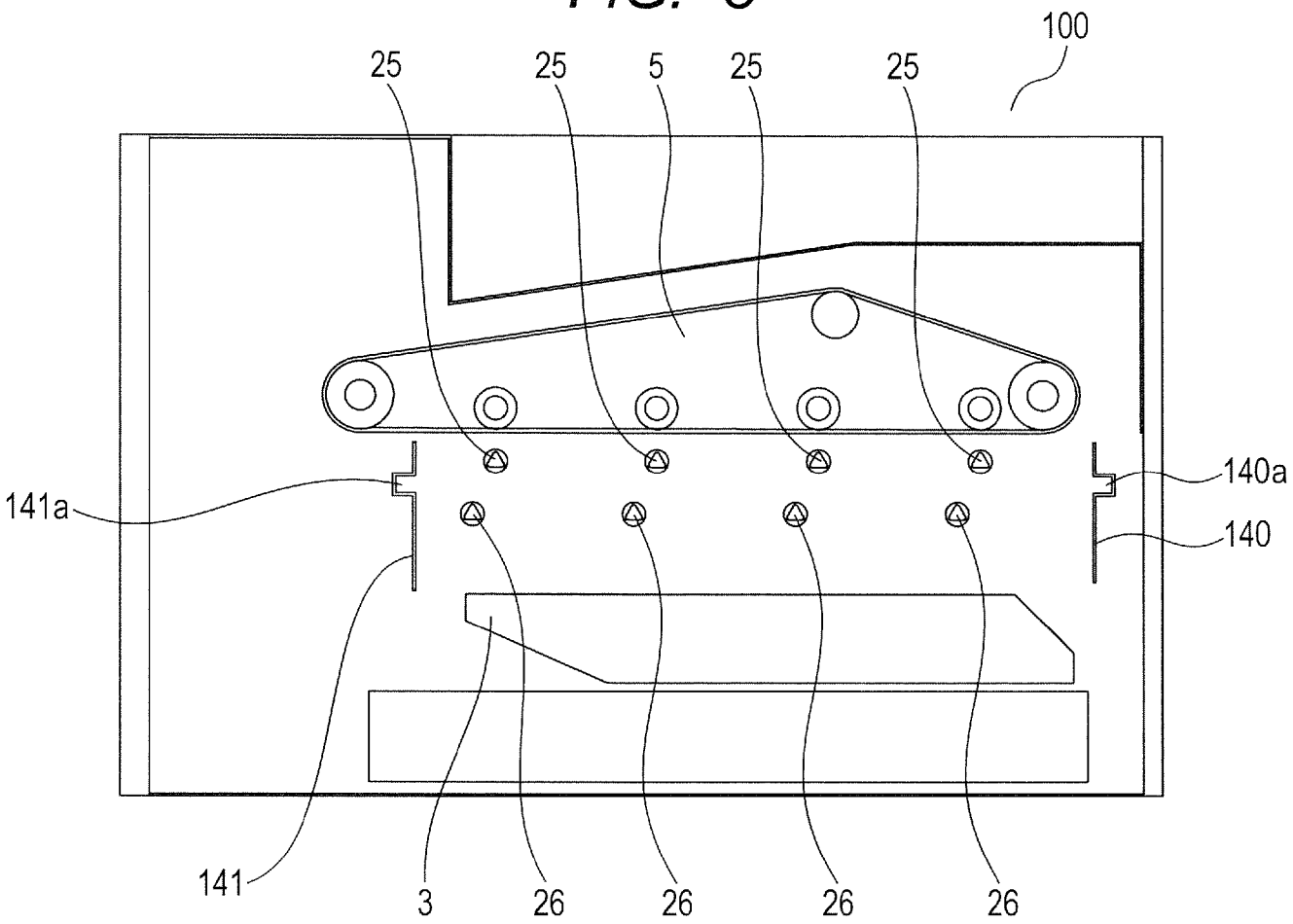
FIG. 3 is a sectional view for illustrating the main body according to the first embodiment.

Referring to FIG. 3, a configuration of a mounting portion of the main body 100 for the pullout member 130 will be described. Note that, in FIG. 3 and FIG. 4, for ease of understanding of the configuration of the mounting portion, a part of components of the main body 100 is not illustrated.

In the main body 100, guiding members 140 and 141 configured to guide the pullout member 130 along the moving direction thereof are provided to face each other. Guiding grooves 140*a* and 141*a* are formed respectively in the guiding members 140 and 141. Those guiding grooves 140*a* and 141*a* serve as parts that respectively guide guided portions 130*a* and 130*b* described below (see FIG. 4 and FIG. 5) of the pullout member 130. The guiding grooves 140*a* and 141*a* are formed to extend from the vicinity of an inlet of the main body 100 (vicinity of the door 10) to a far side of the main body 100 substantially in the horizontal direction so that the pullout member 130 can be guided from a position at which the pullout member 130 is pulled out of the main body 100 to a position at which the pullout member 130 is received inside the main body 100.

Further, as illustrated in FIG. 3, drum coupling members 25 and development coupling members 26 are provided inside the main body 100 at equal intervals in the horizontal direction. The drum coupling members 25 transfer drive to the drums 1, whereas the development coupling members 26 transfer drive to the developing rollers 40. The drum coupling members 25 and the development coupling members 26 transfer a driving force from a drive source (not shown) to the cartridges P. In a state in which the door 10 is opened, the drum coupling members 25 and the development coupling members 26 are in a retracted state inside side walls. In conjunction with an operation of closing the door 10, the drum coupling members 25 and the development coupling members 26 are configured to move toward the cartridges P.

(Configuration of Pullout Member (Moving Member))

Next, a configuration of the pullout member 130 will be described in detail referring to FIG. 4 and FIG. 5. The guided portions 130*a* and 130*b* to be guided by the guiding grooves 140*a* and 141*a* (see FIG. 3) of the main body 100 are provided at both end portions of the pullout member 130 in an arrangement direction of the cartridges P orthogonal to the moving direction of the pullout member 130. The guided portion 130*a* is guided by the guiding groove 140*a*, and the guided portion 130*b* is guided by the guiding groove 141*a*. Note that, at one end portion in the moving direction of the pullout member 130, a grip portion 28 (FIG. 5) for allowing the user to operate the pullout member 130 is provided.

Further, the pullout member 130 includes mounting portions 130*f* (FIG. 5) describe below, for mounting the cartridges P. Further, holes 13 (FIG. 4) for allowing the laser beams L emitted from the exposure unit 3 to pass therethrough are formed as many as the drums 1 through bottom portions of the mounting portions 130*f*.

On one end side and the other end side in a longitudinal direction of each of the mounting portions 130*f*, guiding portions 130*h*, 130*i*, 130*j*, and 130*k* for mounting the cartridges P into the pullout member 130 are formed to extend in the vertical direction. Further, between the guiding portions 130*h* and 130*i* and between the guiding portions 130*j* and 130*k*, positioning portions 130*p* and 130*q* configured to position the cartridges P with respect to the pullout member 130 are formed. The positioning portions 130*p* and 130*q* are each formed into a V-shape.

Figure 4:
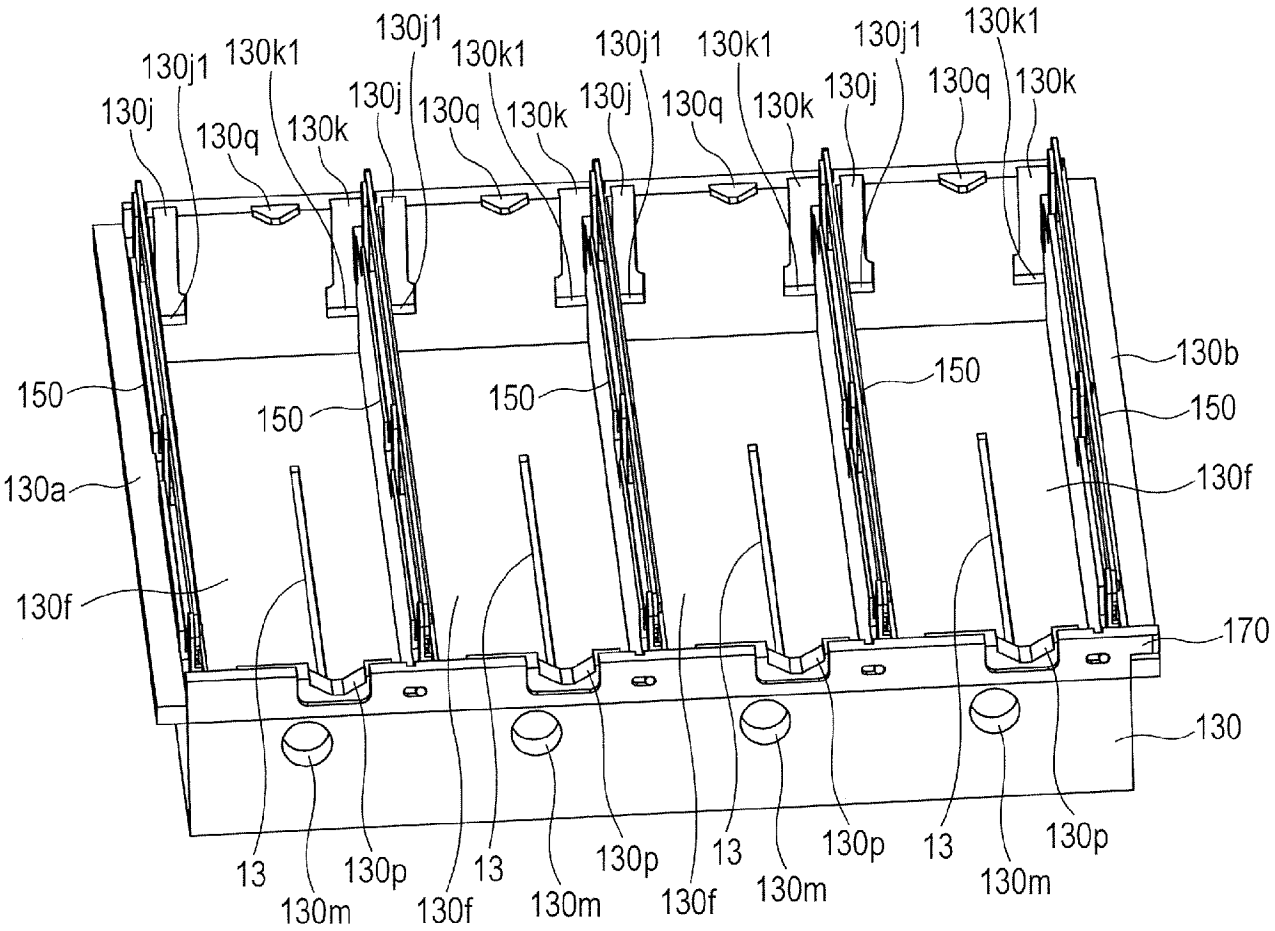
FIG. 4 is a perspective view for illustrating a pullout member according to the first embodiment.
Figure 5:
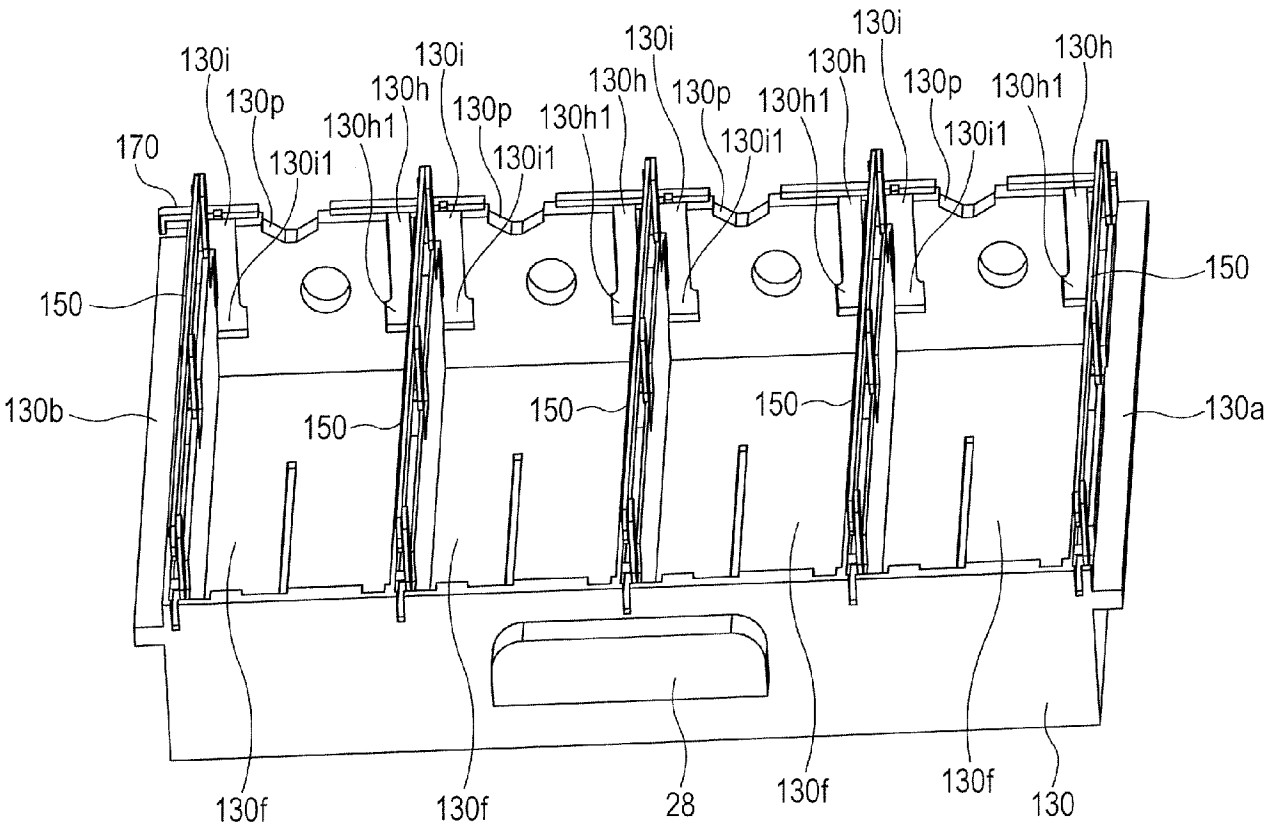
FIG. 5 is a perspective view for illustrating the pullout member according to the first embodiment when viewed from an opposite side.

Further, as illustrated in FIG. 4, opening portions 130*m*, into which the development coupling members described above are to be moved, are formed in the pullout member 130. The development coupling members 26 are moved into the opening portions 130*m* in conjunction with the operation of closing the door 10. Note that, protection portions 150 described in detail below are provided on both sides in a transverse direction of each of the mounting portions 130*f*.

(Cartridge)

Figure 6:
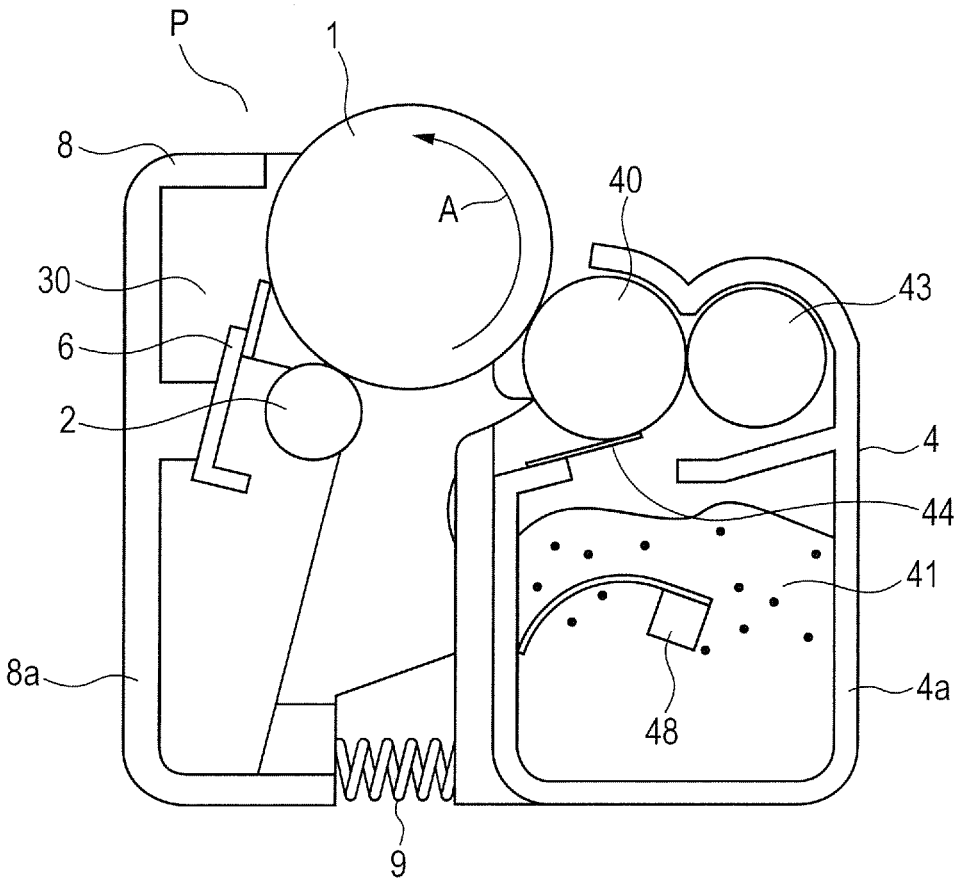
FIG. 6 is a sectional view for illustrating a cartridge according to the first embodiment.

Next, referring to FIG. 6, FIG. 7A, and FIG. 7B, the cartridge P to be mounted into the pullout member 130 will be described. The cartridge P includes a photosensitive member unit 8 as an image bearing member unit and the developing unit 4 as a developer carrying member unit. The pullout member 130 includes a plurality of sets (provided for different colors, respectively) each comprising an image bearing member unit and a developer carrying member unit.

The photosensitive member unit 8 includes the drum 1, a photosensitive member frame 8*a* configured to support the drum 1, the charging unit 2, a cleaning unit 6, and a waste toner container 30 configured to collect the toner removed by the cleaning unit 6. Further, the developing unit 4 includes the developing roller 40, a developing frame 4*a* configured to support the developing roller 40, the toner supply roller 43, the developing blade 44, the toner container 41 configured to contain the toner to be used for image formation, and a conveying member 48 configured to supply the toner in the toner container 41.

As described above, the toner in the toner container 41 is supplied to the toner supply roller 43 by the conveying member 48. Then, the toner supply roller 43 and the developing blade 44 that is held in press-contact with the outer periphery of the developing roller 40 cause the toner to be applied to the outer periphery of the developing roller 40 and to be electrically charged. Then, a developing bias is applied from the main body to the developing roller 40 so that the toner adheres to the latent image formed on the drum 1. With this, the toner image is formed. After the toner image borne on the drum 1 is transferred onto the transfer belt 11, the toner remaining on the surface of the drum 1 is removed by the cleaning unit 6, and collected into the waste toner container 30.

Note that, in a case where the toner in the toner container 41 is consumed, the user only has to replace the cartridge P to perform printing again. Further, as illustrated in FIG. 7A, at one end portion of the cartridge P, a first coupling member 47 configured to receive the driving force through intermediation of the drum coupling member 25 on the main body side is supported to be rotatable. In addition, a second coupling member 45 configured to receive the driving force through intermediation of the development coupling member 26 is also supported to be rotatable.

The first coupling member 47 is provided at the one end in the axial direction of the drum 1 (the axial direction of the drum 1 is hereinafter referred to as "longitudinal direction") to receive the driving force from the main body for rotating the drum 1. Further, the driving force received by the second coupling member 45 is transmitted to the developing roller 40, the toner supply roller 43, and the conveying member 48 through intermediation of an intermediate gear (not shown) to rotate those components.

An outer periphery of the second coupling member is covered with a cylindrical rib. With this, an engagement portion 71*a* is formed on a side cover 71 fixed to an outside of the toner container 41. The second coupling member 45 is configured to be turnable about the engagement portion 71*a*. Further, as illustrated in FIG. 7B, an engagement portion 70*a* is formed on a side opposite to the engagement portion 71*a* in the longitudinal direction. The engagement portion 70*a* is formed on a side cover 70. Those engagement portions 71*a* and 70*a* are formed in the developing unit 4.

Further, hole portions 8*b* and 8*c* configured to support the engagement portions 71*a* and 70*a* are formed through the photosensitive member frame 8*a*. The hole portions 8*b* and 8*c* formed through the photosensitive member frame 8*a* are engaged with the engagement portions 71*a* and 70*a* provided on the developing unit 4. With this, the photosensitive member unit 8 and the developing unit 4 are coupled to each other.

Specifically, plays are secured between the hole portion 8*b* and the engagement portion 71*a* and between the hole portion 8*c* and the engagement portion 70*a* so that the engagement portions 71*a* and 70*a* are movable respectively with respect to the hole portions 8*b* and 8*c*. Thus, the developing unit 4 can be moved with respect to the photosensitive member unit 8. In other words, the developing roller 40 is configured to be movable with respect to (configured to be in contact with and separated from) the drum 1. Specifically, as illustrated in FIG. 6, FIG. 7A, and FIG. 7B, a spring 9 as a biasing member is interposed between the photosensitive member unit 8 and the developing unit 4. The spring 9 generates a predetermined pressure for pressing the developing roller 40 against the drum 1.

Figure 7A:
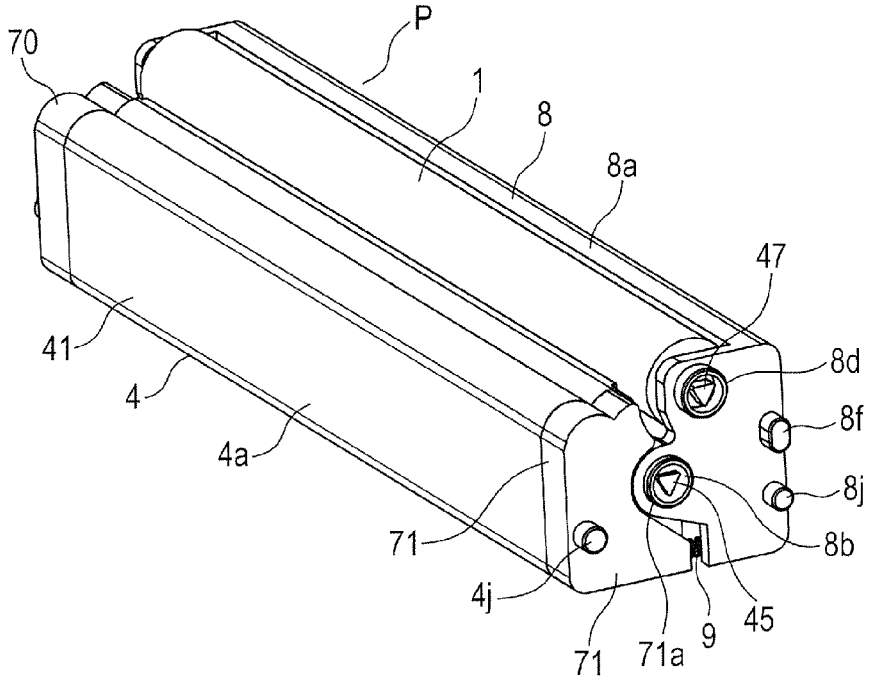
FIGS. 7A and 7B are each a perspective view for illustrating the cartridge according to the first embodiment.
Figure 7B:
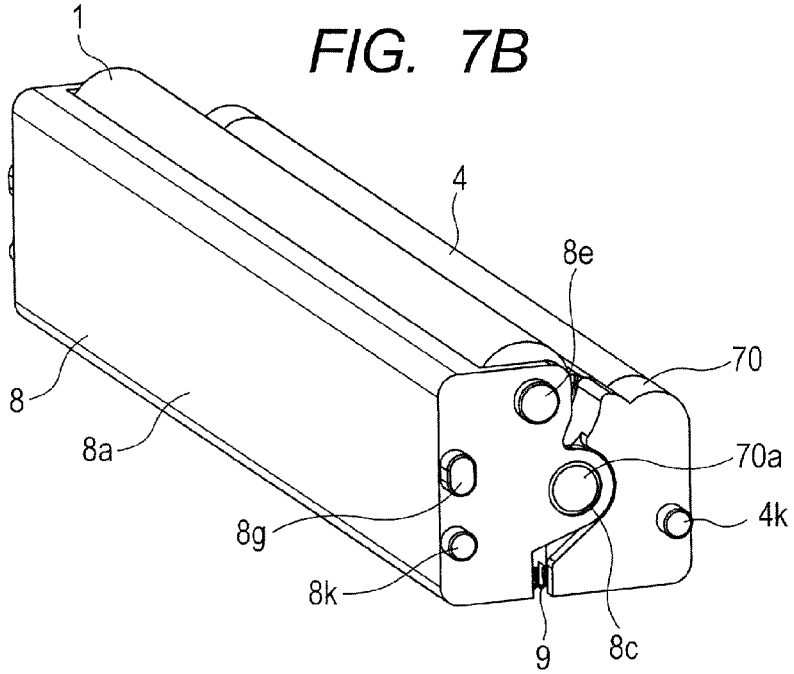

As illustrated in FIG. 7A, an outer periphery of the first coupling member 47 is covered with a cylindrical rib. With this, a positioned portion 8*d* is formed. Further, as illustrated in FIG. 7B, on a side opposite to the positioned portion 8*d* in the longitudinal direction, a positioned portion 8*e* is formed of a cylindrical protrusion. Still further, as illustrated in FIG. 7A, a rotation regulated portion 8*f* is provided below the positioned portion 8*d*. As illustrated in FIG. 7B, a rotation regulated portion 8*g* is provided below the positioned portion 8*e*. The rotation regulated portions 8*f* and 8*g* are each formed into a shape of a substantially rectangular column extending in the same direction as a direction of mounting the cartridge P into the pullout member 130.

The positioned portions 8*d* and 8*e* and the rotation regulated portions 8*f* and 8*g* each have a function to position the cartridge P in the pullout member 130. Further, columnar regulated portions 8*j*, 4*j*, 8*k*, and 4*k* are provided below the rotation regulated portions 8*f* and 8*g*. The regulated portions 8*j* and 8*k* and the regulated portions 4*j* and 4*k* are provided respectively on the photosensitive member unit 8 and the developing unit 4 across the drum 1. Functions of those regulated portions will be described in detail below.

(Mounting of Cartridge into Pullout Member)

Figure 8A:
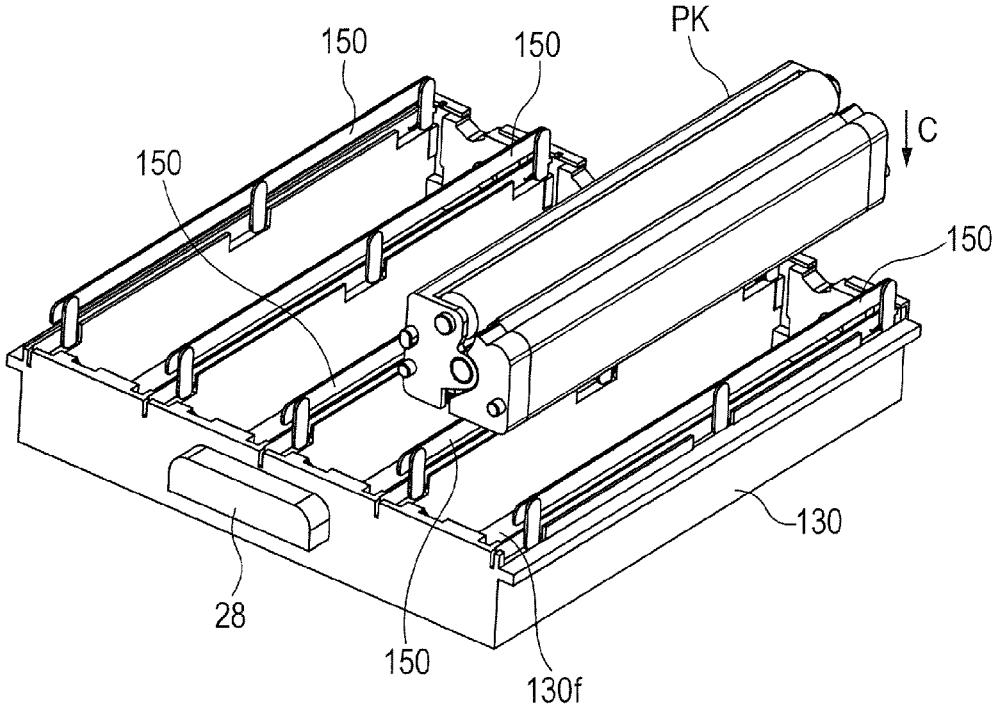
FIGS. 8A and 8B are respectively a perspective view and a side view for illustrating the pullout member according to the first embodiment.
Figure 8B:
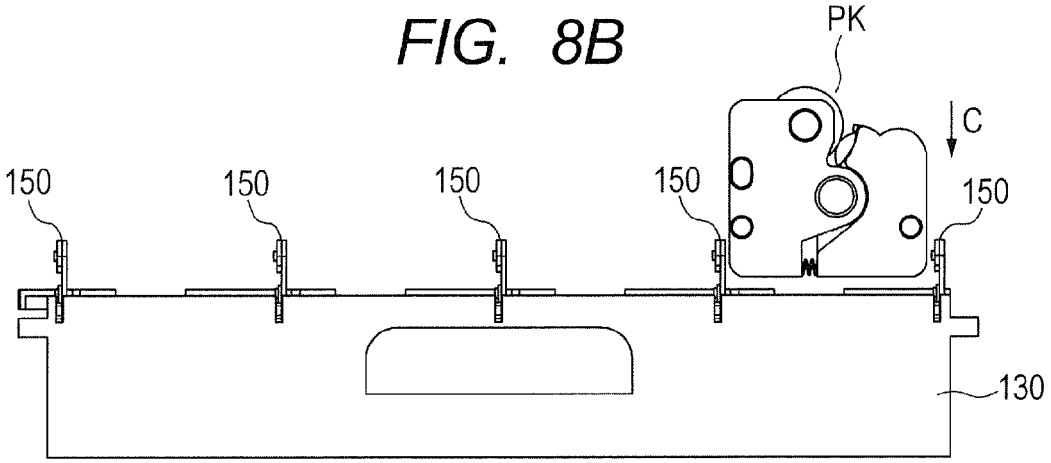

Next, referring to FIG. 8A, FIG. 8B, FIG. 9A, and FIG. 9B, how the cartridges P are mounted into the pullout member 130 will be described. Note that, in the description, mounting of the cartridge PK is taken as an example. FIG. 8A and FIG. 8B are respectively a perspective view and a side view for illustrating how the cartridge PK is mounted into the pullout member. Further, FIG. 9A and FIG. 9B are each a sectional view for illustrating how the mounting of the cartridge PK is completed.

In order to mount the cartridge PK, as illustrated in FIG. 8A, first, the cartridge PK is brought close to the pullout member 130 in the direction indicated by the arrow C, which is substantially the same as the gravity direction. Then, as illustrated in FIG. 8B, the cartridge PK is mounted into the mounting portion 130*f* while being roughly guided along the protection portions 150 provided at both ends in the transverse direction of the mounting portion 130*f*. Referring to FIG. 9A and FIG. 9B, subsequent mounting behavior of the cartridge PK at one end of the pullout member 130 will be described. In FIG. 9A and FIG. 9B, the pullout member 130 is viewed from the same side as that in FIG. 8B, and is partially cut out for the sake of simplicity of description.

Figure 9A:
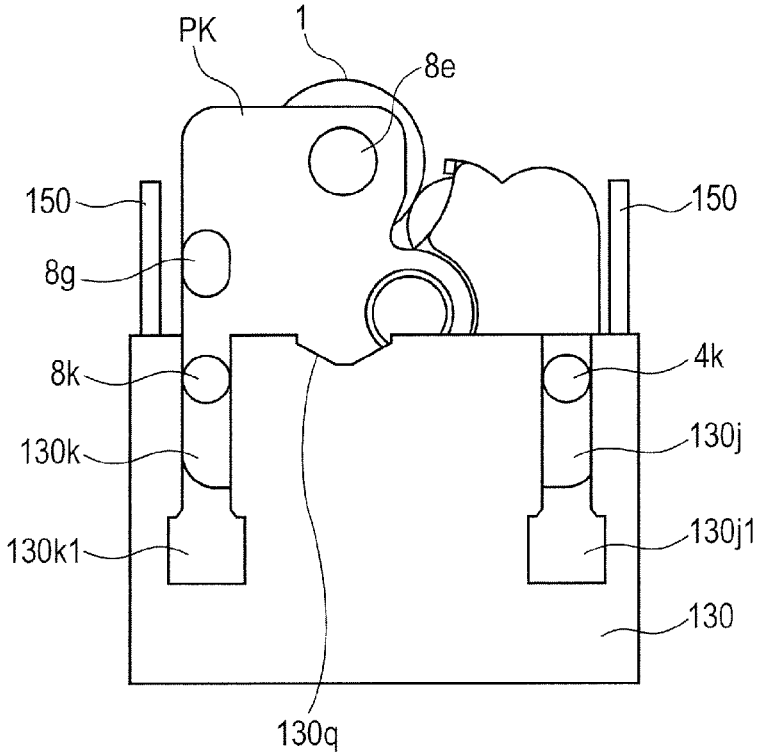
FIGS. 9A and 9B are each a sectional view for illustrating how the cartridge according to the first embodiment is mounted.

As illustrated in FIG. 9A, the regulated portions 8*k* and 4*k* provided at both end portions in a transverse direction of the cartridge PK are mounted along the guiding portions 130*j* and 130*k* of the pullout member 130. In this way, a posture of the cartridge PK is determined. Further, the user mounts the rotation regulated portion 8*g* along the guiding portion 130*k*. In this way, the cartridge PK is mounted further into the pullout member 130 while being guided along the guiding portions 130*j* and 130*k*.

Figure 9B:
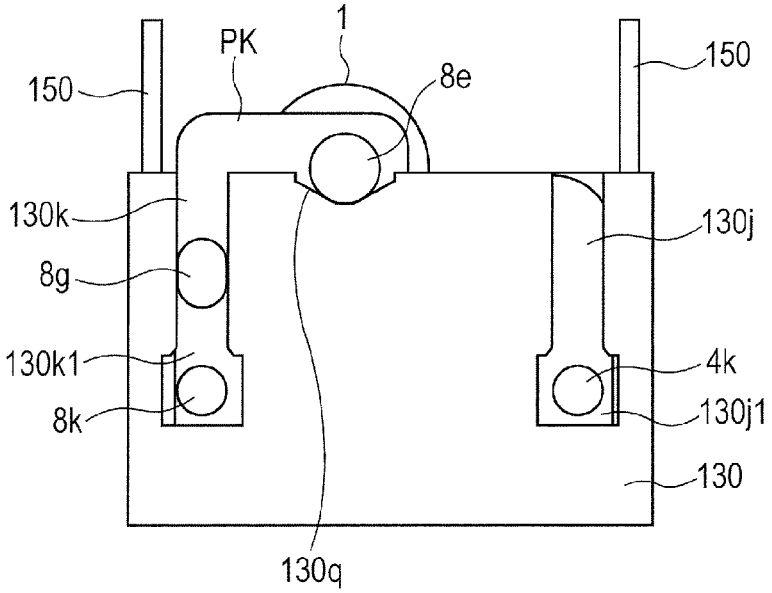

Further, when the cartridge PK is mounted still further into the pullout member 130, as illustrated in FIG. 9B, the positioned portion 8*e* abuts against the positioning portion 130*q* formed on the pullout member 130. The positioning portion 130*q* is formed into the V-shape. Thus, through abutment against the columnar positioned portion 8*e*, the cartridge PK can be positioned in the mounting direction thereof.

Further, the rotation regulated portion 8*g* is held in abutment against side surfaces of the guiding portion 130*k*, and hence the posture of the cartridge PK can be determined in a rotating direction thereof. In this way, by the positioned portion 8*e* and the rotation regulated portion 8*g*, the cartridge PK is positioned in the pullout member 130. Note that, the regulated portions 8*k* and 4*k* are located at retraction portions 130*j*1 and 130*k*1 (see FIG. 4 as well) formed on a far side of the guiding portions 130*j* and 130*k*. Widths of the guiding portions 130*j* and 130*k* at those positions are set to be large, and hence the regulated portions 8*k* and 4*k* are not held in abutment against the pullout member 130.

In this way, positioning of the cartridge PK with respect to the pullout member 130 is not hindered. The other end of the cartridge PK is mounted in the same way, and hence is not described in detail. Similarly, the cartridges PY, PM, and PC are mounted into the pullout member 130.

(Protection Portion)

Figure 10:
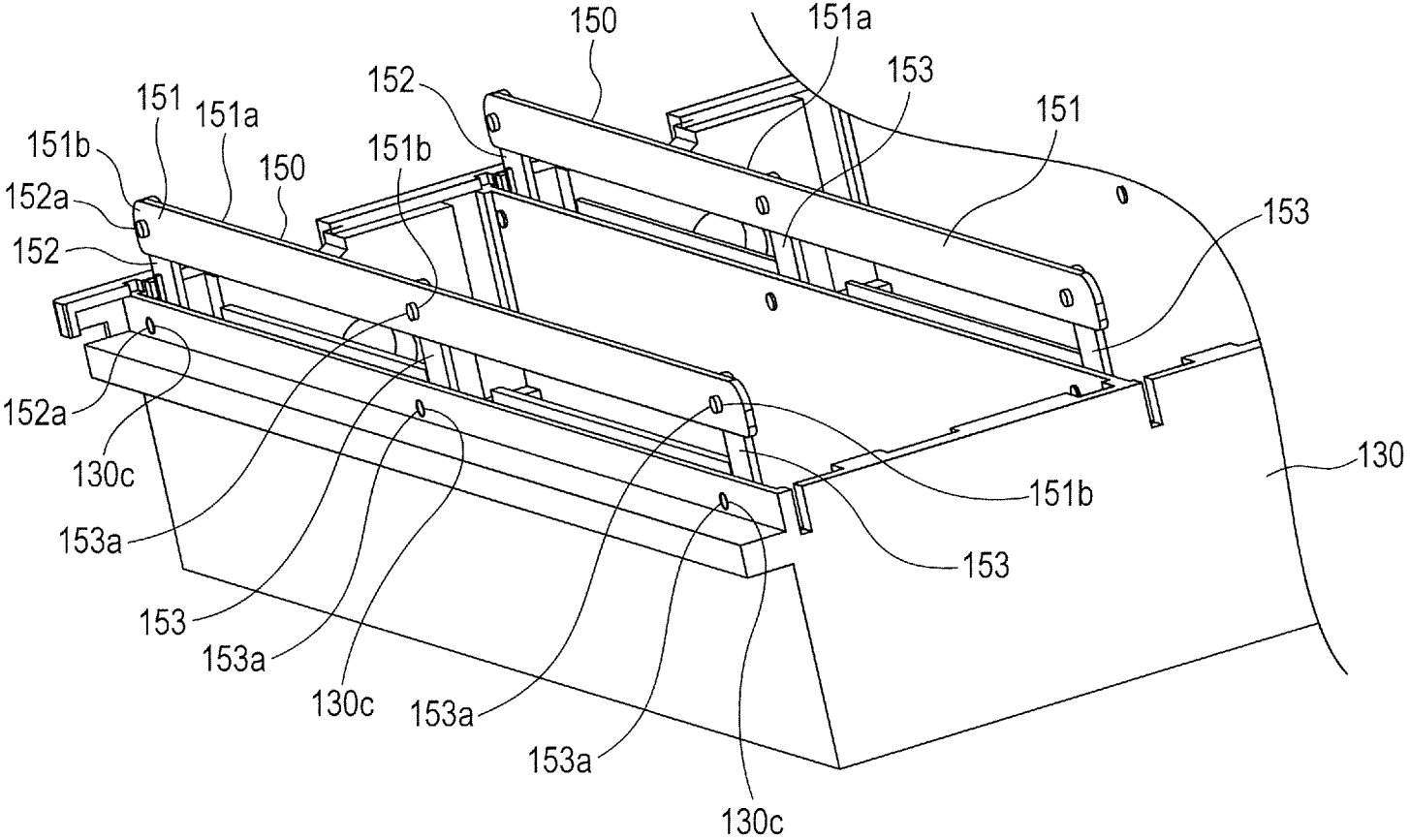
FIG. 10 is a perspective view for illustrating the pullout member according to the first embodiment.

Next, referring to FIG. 10, FIG. 11, FIG. 12, FIG. 13A, and FIG. 13B, the protection portions 150 provided on the pullout member 130 will be described. As illustrated in FIG. 10, the protection portions 150 each includes a four-bar parallel linkage formed of a plate-shaped protection member 151 including a projecting portion 151*a* along one end thereof, and a first link member 152 and two second link members 153 as a link mechanism to be coupled to the protection member 151.

Specifically, link shafts 152*a* provided at both ends of each of the first link members 152 are engaged respectively with a link hole 151*b* of the protection member 151 and a link hole 130*c* of the pullout member 130 in a freely pivotable manner. Further, a distal end of each of the link shafts 152*a* is molten and flattened by a method such as heat staking to increase a shaft diameter thereof. In this way, retention of the link shafts 152*a* to the link holes 130*c* and 151*b* is performed.

Similarly, link shafts 153*a* provided at both ends of each of the second link members 153 are engaged respectively with another link hole 151*b* of the protection member 151 and another link hole 130*c* of the pullout member 130 in a freely pivotable manner. Further, a distal end of each of the link shafts 153*a* is molten and flattened by the method such as heat staking to increase a shaft diameter thereof. In this way, retention of the link shafts 153*a* to the other link holes 130*c* and 151*b* is performed.

Figure 11:
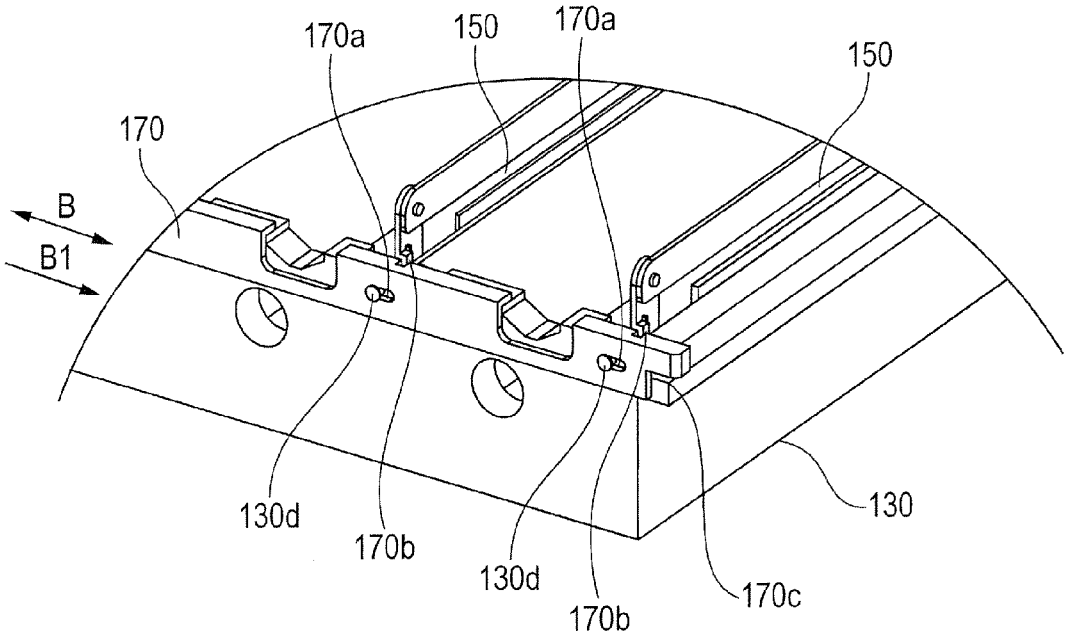
FIG. 11 is a perspective view for illustrating the pullout member according to the first embodiment.

Note that, as illustrated in FIG. 11, a lock member 170 having a function to maintain postures of the protection members 151 in the vertical direction is provided along an end portion of the pullout member 130 on the far side in the direction orthogonal to the moving direction of the pullout member 130. The lock member 170 has cutout portions 170*b*, an abutment portion 170*c*, and engagement holes 170*a* each formed to have a clearance in a direction indicated by the arrow B in FIG. 11. Fixing shafts 130*d* provided on the pullout member 130 are inserted through the engagement holes 170*a*. The lock member 170 is provided along the pullout member 130 so as to be movable in the direction indicated by the arrow B in FIG. 11.

Further, the lock member 170 is biased in a direction indicated by the arrow B1 in FIG. 11 by a biasing member described below. Note that, a distal end of each of the fixing shafts 130*d* is molten and flattened by the method such as heat staking to increase a shaft diameter thereof. In this way, retention of the fixing shafts 130*d* to the engagement holes 170*a* is performed.

Figure 12:
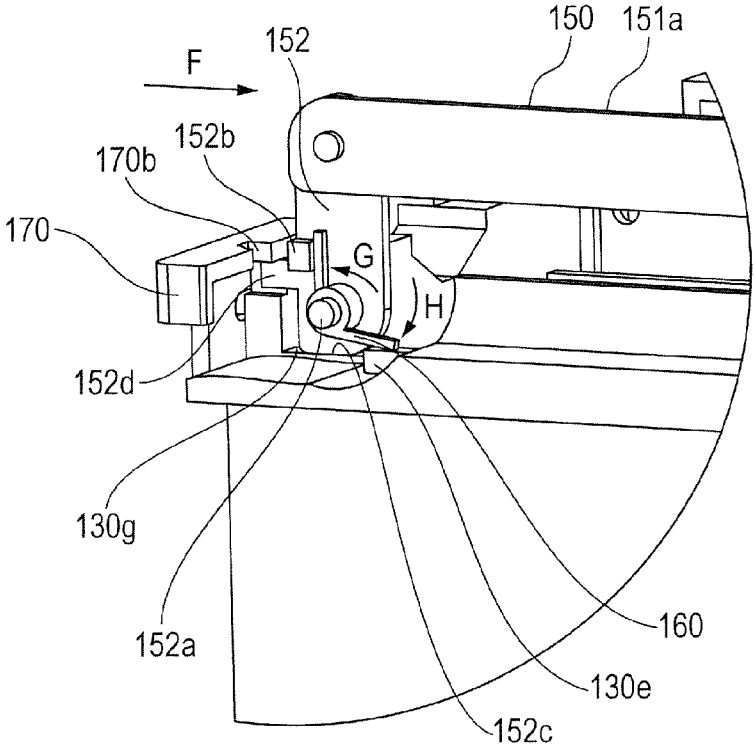
FIG. 12 is a perspective view for illustrating a protection portion according to the first embodiment.

Next, referring to FIG. 12, the configuration around the first link member 152 will be described. FIG. 12 is a perspective view for illustrating a state in which the lock member 170 illustrated in FIG. 11 is shifted in the direction indicated by the arrow B1 (FIG. 11) (state in which the cutout portions 170*b* of the lock member 170 and lock claws 152*d* of the first link members 152 are not positionally aligned with each other in the direction indicated by the arrow B in FIG. 11). Further, some of the components are cut out for the sake of simplicity of description.

At a side end portion on the far side in the moving direction of the pullout member 130, a biasing member 160 (torsion spring) as a member to be supported by the pullout member 130 is provided on the link shaft 152*a* of the first link member 152 on the far side. Further, an arm at one end of the biasing member 160 is held in abutment against an engaging protrusion 152*b* of the first link member 152, and an arm at the other end thereof is held in abutment against an engaging protrusion 130*e* of the pullout member 130. With this, the first link member 152 is biased in a direction indicated by the arrow G in FIG. 12.

Further, in the state of FIG. 12 in which the lock member 170 is shifted in the direction indicated by the arrow B1 (FIG. 11), an abutment portion 152*c* of the first link member 152 and an abutment portion 130*g* of the pullout member 130 are held in abutment against each other. With this, the first link member 152, which is biased in the direction indicated by the arrow G in FIG. 12, is stopped from being pivoted in the direction indicated by the arrow G. Note that, the lock claw 152*d* of the first link member 152 is held in abutment against the lock member 170. Thus, even when a force in a direction indicated by the arrow F illustrated in FIG. 12 is applied to the protection member 151, the first link member 152 is prevented from pivoting in a direction indicated by the arrow H in FIG. 12. The protection portion 150 in this state is hereinafter described as "the protection portion 150 is located at a protection position."

Figure 13A:
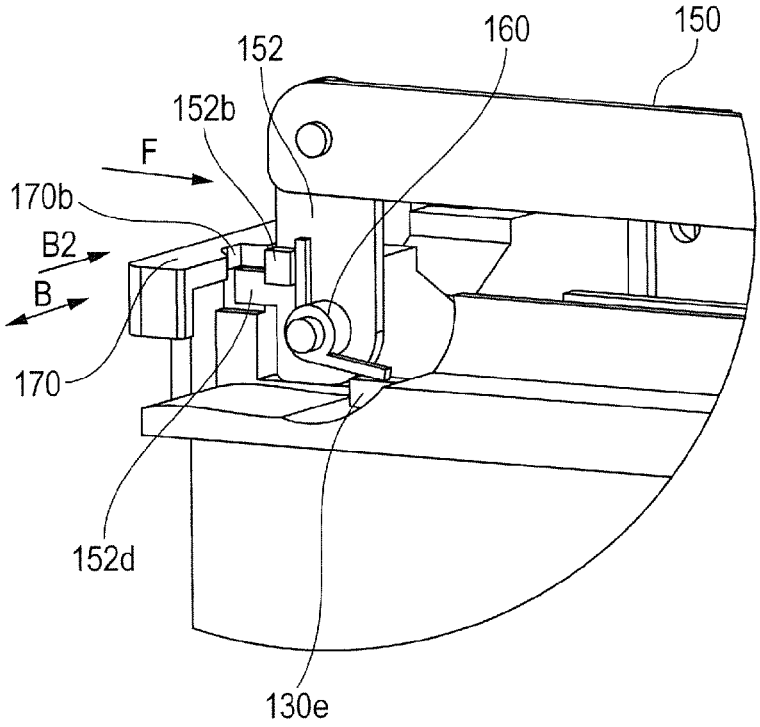
FIGS. 13A and 13B are each a perspective view for illustrating the protection portion according to the first embodiment.
Figure 13B:
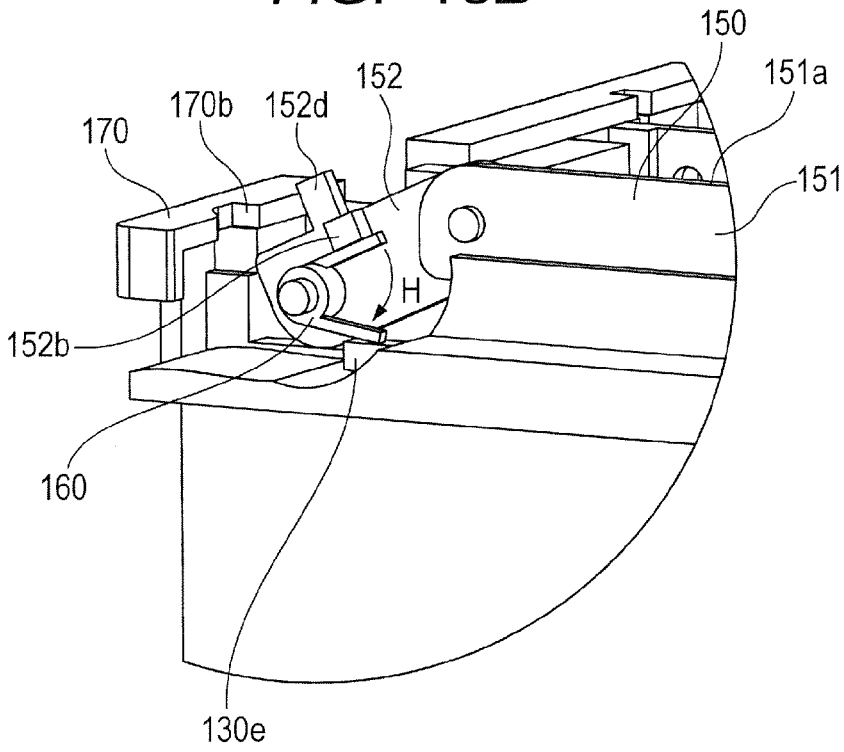

Next, referring to FIG. 13A and FIG. 13B, a state in which the lock member 170 is moved in a direction indicated by the arrow B2 in FIG. 13A will be described. In FIG. 13A and FIG. 13B, some of the components are cut out for the sake of simplicity of description. As illustrated in FIG. 13A, when the lock member 170 is moved in the direction indicated by the arrow B2 in FIG. 13A, the cutout portion 170*b* of the lock member 170 and the lock claw 152*d* of the first link member 152 are positionally aligned with each other in the direction indicated by the arrow B in FIG. 13A.

In this state, when the force in the direction indicated by the arrow F in FIG. 13A is applied to the protection member 151, the lock claw 152*d* of the first link member 152 passes through the cutout portion 170*b* of the lock member 170 (in other words, engagement therebetween is released). With this, the first link member 152 is pivoted in the direction indicated by the arrow H in FIG. 13B against a biasing force of the biasing member 160 (FIG. 13B). As described above, the protection portion 150 includes the four-bar linkage. Thus, when the first link member 152 is pivoted in the direction indicated by the arrow H in FIG. 13B, the protection member 151 is lowered.

Note that, the above-mentioned members 152, 153, 160, and 170 each function as a holding mechanism described below. Specifically, when the moving member is moved between the inside position and the outside position, the protection member is held at a position at which the protection member is projected with respect to the surface of the image bearing member, and when the moving member is located at the inside position so that the image formation is performed, the protection member is held at a position at which the protection member is not projected with respect to the surface of the image bearing member.

(Protection of Drums in Pullout Unit)

Figure 14A:
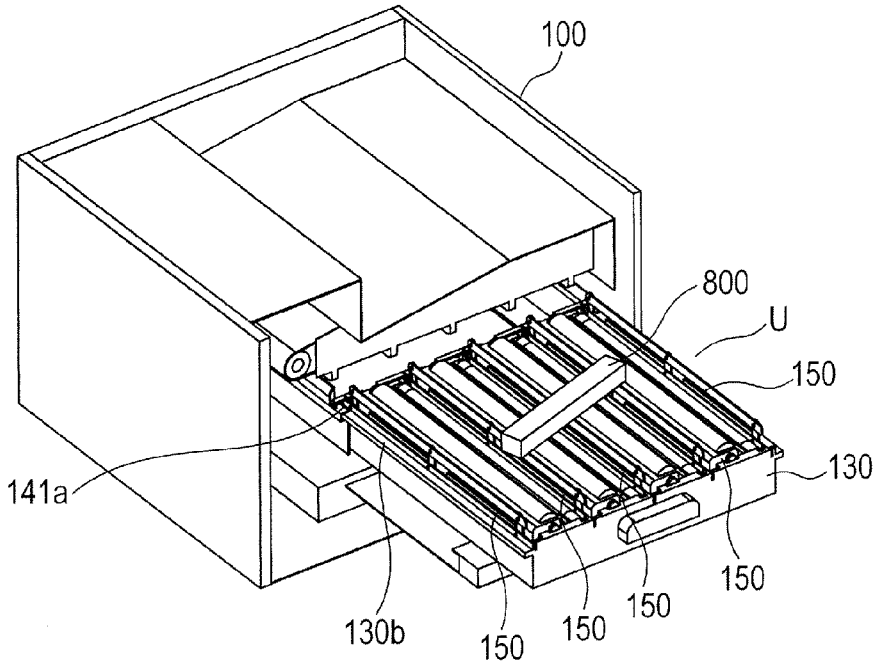
FIGS. 14A and 14B are respectively a perspective view and a side view for illustrating the main body according to the first embodiment.
Figure 14B:
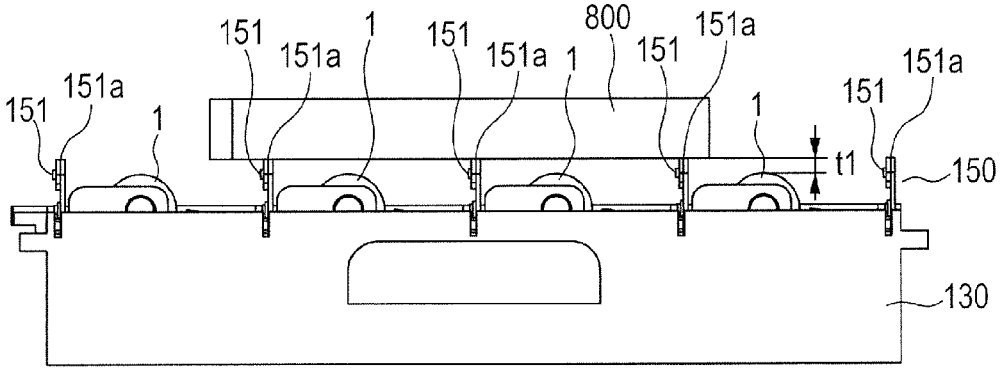

The pullout member 130 having the cartridges P mounted therein is referred to as a pullout unit U. In FIG. 14A and FIG. 14B, the pullout unit U is located at the pullout position. In the embodiment, through a pullout operation (operation reverse to a mounting operation described in detail below), at the pullout position, the projecting portion 151*a* of each of the protection members 151, which is located vertically below the surface of corresponding one of the drums 1, is displaced and held by the holding mechanism at a position at a distance t1 above the surface of the corresponding one of the drums 1 as illustrated in FIG. 14B. With this configuration, even when a foreign object 800 falls onto the pullout unit U in the state in which the pullout unit U is located at the pullout position, the foreign object 800 abuts against the projecting portions 151*a* of the protection members 151 of the protection portions 150, and is prevented from falling onto the drums 1 (see FIG. 14B).

In other words, the protection members 151 protect the drums 1 that are exposed vertically upward from the pullout unit U. In this state, the protection portions 150 are located at the protection positions, and hence the protection members 151 cannot be lowered (see FIG. 12). Thus, even when a load of the foreign object 800 is applied to the protection portions 150, the foreign object 800 can be reliably prevented from falling onto the drums 1. Therefore, the foreign object 800 does not abut against the drums 1, and hence does not damage the drums 1. In this way, with this configuration, even when the foreign object 800 falls onto the pullout unit U at the pullout position, the drums 1 are prevented from being damaged. As a result, image defects that may be caused by the damage to the drums 1 can be prevented.

Note that, as specific examples of the foreign object 800, an object held by the user and a cartridge that is replaced by the user are conceived. For example, when the user tries to replace the cartridge P in the state in which the pullout unit U is located at the pullout position, a pen in a chest pocket of the user may fall as the foreign object 800 onto the pullout unit U. Alternatively, the cartridge P that is replaced by the user may slip off his/her hands onto the pullout unit U. As a matter of course, those are merely examples of the foreign object 800, and hence the foreign object 800 is not necessarily limited thereto.

(Mounting of Pullout Unit into Main Body)

Figure 15A:
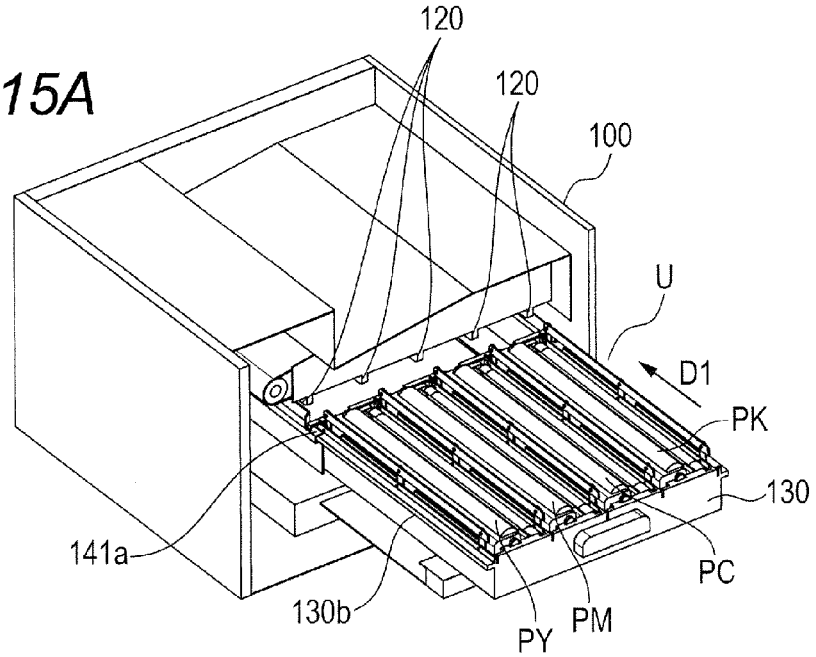
FIGS. 15A and 15B are each an explanatory view for illustrating how the pullout member according to the first embodiment is mounted.
Figure 15B:
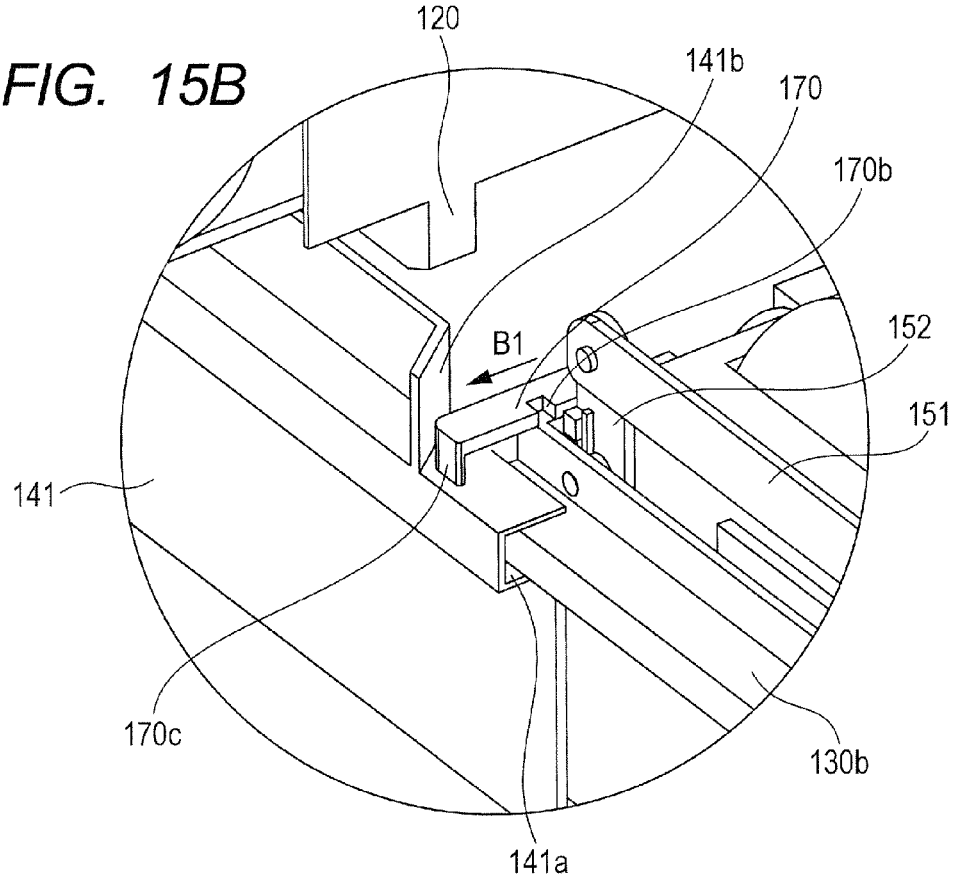

Referring to FIG. 15A, FIG. 15B, FIG. 16, FIG. 17, FIG. 18A, and FIG. 18B, an operation of mounting the pullout unit U into the main body 100 will be described. FIG. 15A is a perspective view for illustrating the state in which the pullout unit U is located at the pullout position located outside of the main body 100 according to the embodiment. FIG. 15B is an enlarged view for illustrating a mounting portion of the pullout member 130 with respect to the main body 100.

As illustrated in FIG. 15A, the main body 100 includes abutment protrusions 120 as many as the cartridges P that can be mounted into the pullout member 130. As illustrated in FIG. 15B, in this state, the lock member 170 is shifted in the direction indicated by the arrow B1 in FIG. 15B, and hence the first link member 152 cannot be pivoted. In other words, the protection portion 150 is held at the protection position.

Now, how the pullout unit U is mounted into the main body 100 is sequentially described. In FIG. 15A, the pullout unit U is mounted in the direction indicated by the arrow D1 in a manner that the guided portion 130*b* of the pullout member 130 is guided along the guiding groove 141*a* on the main body 100 side.

Figure 16:
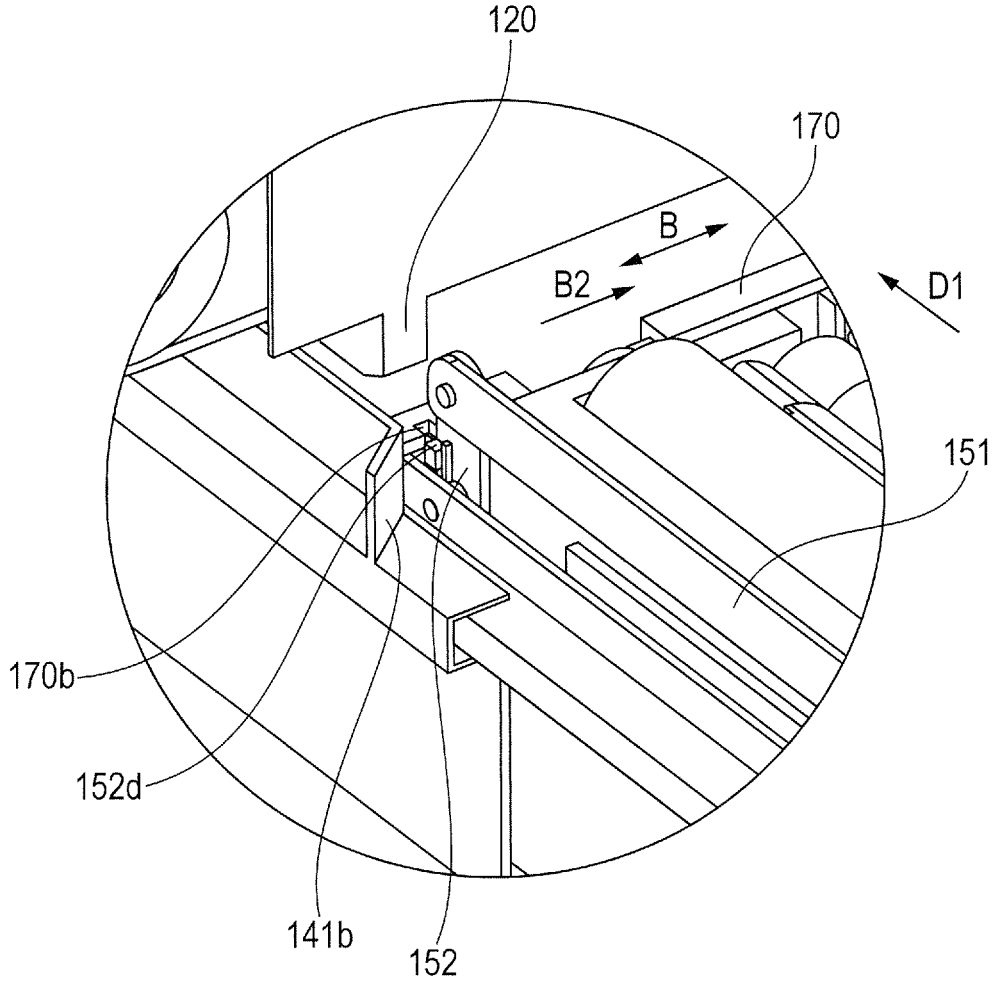
FIG. 16 is an explanatory view for illustrating how the pullout member according to the first embodiment is mounted.

When the pullout unit U is mounted up to the position in FIG. 16, the abutment portion 170*c* of the lock member 170 of the pullout unit U abuts against a lock abutment portion 141*b* of the main body 100. Note that, the lock abutment portion 141*b* of the main body 100 is provided obliquely between the mounting direction of the pullout unit and the direction indicated by the arrow B2. Thus, when the lock member 170 abuts against the lock abutment portion 141*b* of the main body 100, the lock member 170 is moved in the direction indicated by the arrow B2 in FIG. 16. At this time, the cutout portion 170*b* of the lock member 170 and the lock claw 152*d* of the first link member 152 are positionally aligned with each other in the direction indicated by the arrow B in FIG. 16 (see FIG. 13A as well).

Figure 17:
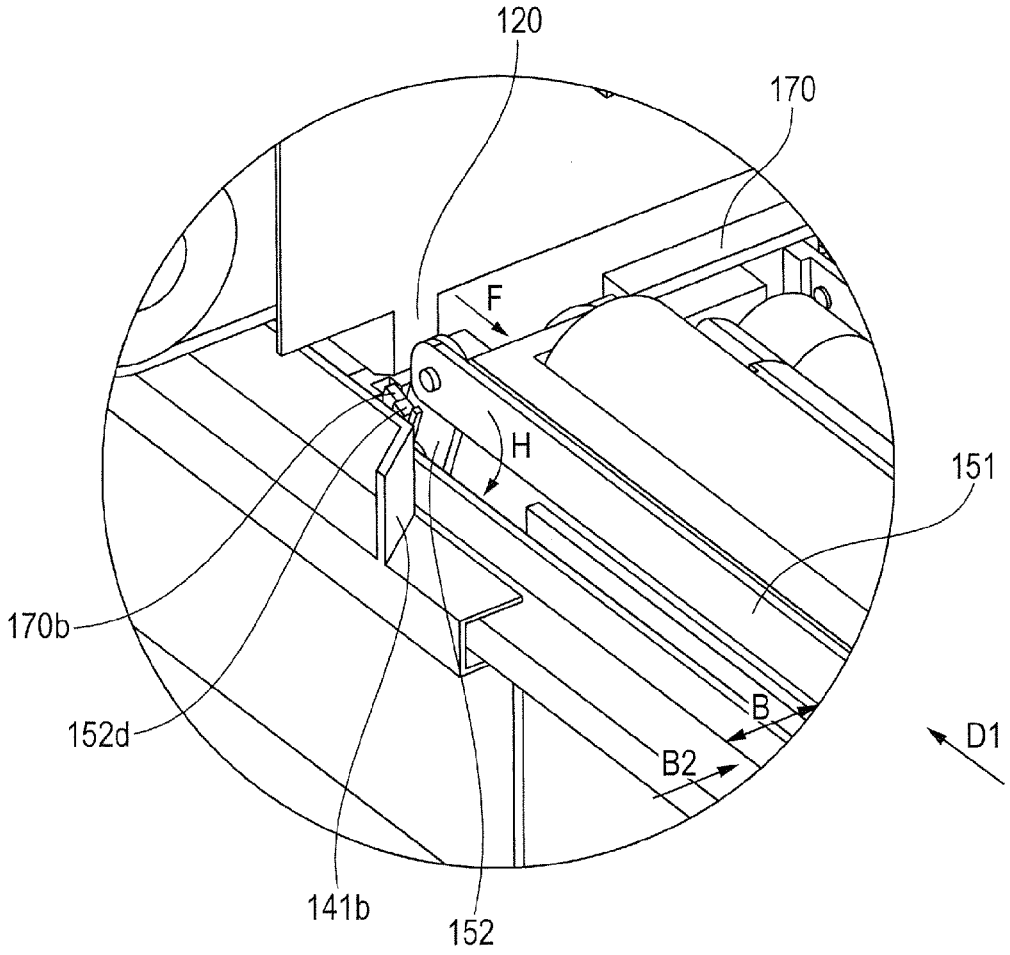
FIG. 17 is an explanatory view for illustrating how the pullout member according to the first embodiment is mounted.

Then, when the pullout unit U is moved further in the mounting direction, as illustrated in FIG. 17, the protection member 151 of the protection portion 150 abuts against the abutment protrusion 120 of the main body 100 (provided at a position on the far side with respect to the lock abutment portion 141*b*). With this, the force in the direction indicated by the arrow F in FIG. 17 is applied to the protection member 151. As a result, the first link member 152 is pivoted in the direction indicated by the arrow H in FIG. 17, and the protection member 151 starts to be lowered (see FIG. 13B as well). Then, when the pullout unit U is moved still further in the mounting direction, the abutment protrusion 120 of the main body 100 sufficiently abuts against the protection member 151. With this, the protection portion 150 is lowered.

Figure 18A:
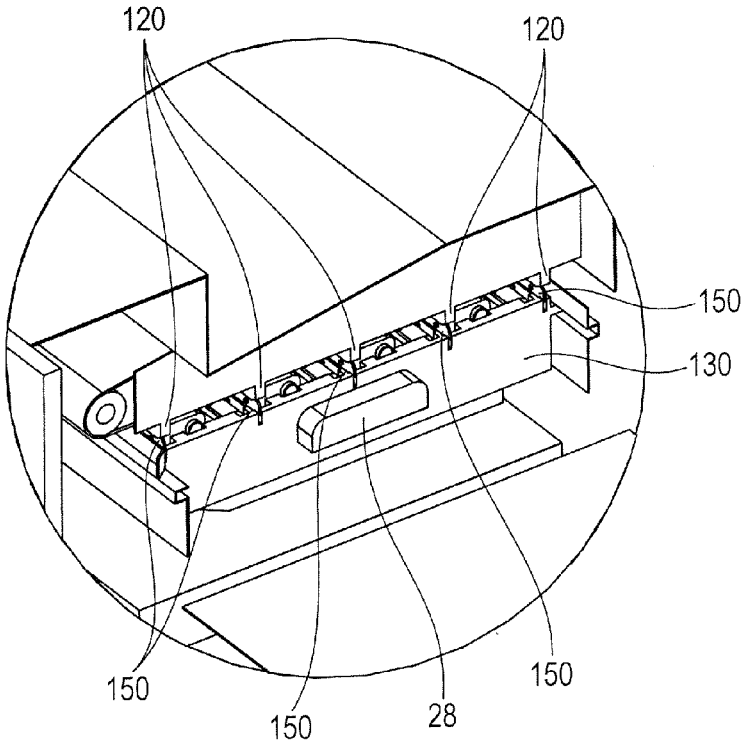
FIGS. 18A and 18B are respectively a perspective view and a side view for illustrating the main body according to the first embodiment.
Figure 18B:
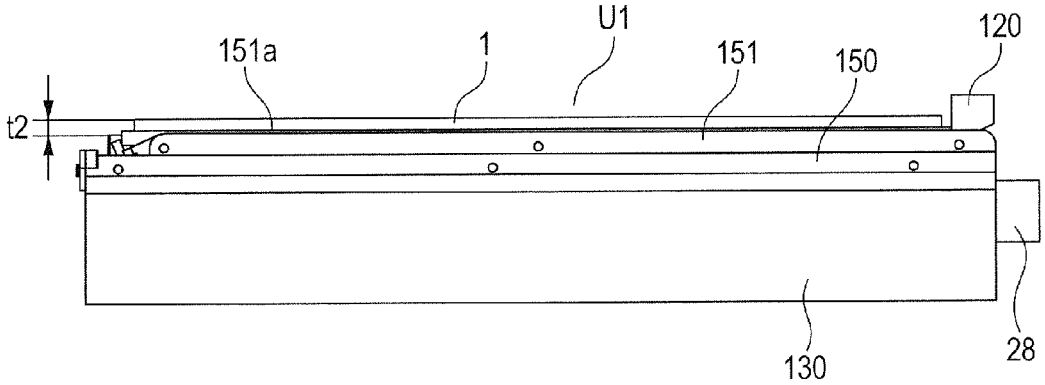

Then, as illustrated in FIG. 18A, in the state in which the pullout unit U is mounted up to the mounting position, the abutment protrusions 120 of the main body 100 abut against the protection members 151 to hold the protection portions 150 at the lowered positions. FIG. 18B is a schematic view for illustrating the pullout unit U as viewed from a left surface side of the main body 100. As illustrated in FIG. 18B, when the protection portion 150 is located at the lowered position, the projecting portion 151*a* of the protection member 151 is located at a distance t2 below a top of the surface of the drum 1, and hence does not interfere with the transfer member 5.

Further, in the configuration according to the embodiment, in conjunction with an operation of opening the door 10, the transfer member 5 is retracted from an image formation position (position of abutting against the drums 1) (the transfer member 5 is separated from the drums 1) (not shown). Thus, during the operation of moving the pullout unit U to the mounting position, the surfaces of the drums 1 and the surface of the transfer member 5 are not rubbed against each other. Meanwhile, in conjunction with the operation of closing the door 10, both the drum coupling members 25 and the development coupling members 26 (see FIG. 3) move into the pullout member 130, and the transfer member 5 is lowered in conjunction with the door 10. In this way, the cartridges P received in the pullout member 130 are positioned in the main body 100.

As described above, according to the holding mechanism of the embodiment, when the moving member is moved between the inside position and the outside position, the protection members are held at the positions vertically above the surfaces of the image bearing members, and when the moving member is located at the inside position so that the image formation is performed, the protection members are held at the positions vertically below the surfaces of the image bearing members. With this, according to the embodiment, the surfaces of the drums 1 can be protected when the pullout member 130 is pulled out within the small space.

Second Embodiment

Next, a second embodiment of the present invention will be described. In the first embodiment, the protection member 151 provided on the pullout unit as the moving member is an integral structure elongated in the mounting direction (moving direction). Meanwhile, in a pullout unit according to the embodiment, a plurality of first protection members and a plurality of second protection members are provided respectively on the far side and a near side in the mounting direction.

With this, according to the embodiment, even when the pullout unit is not fully mounted, the protection members on the far side are lowered without lowering the protection members on the near side. With this, the drums 1 can be protected from the foreign object 800 that may fall thereonto. Note that, the same parts as those in the configurations of the main body and the cartridges according to the first embodiment are not described in detail.

Now, referring to FIG. 19A, FIG. 19B, FIG. 20A, and FIG. 20B, first protection portions 250 each including a first protection member 251, and second protection portions 260 each including a second protection member 261, which are provided on a pullout member 230 according to the embodiment, will be described.

Figure 19A:
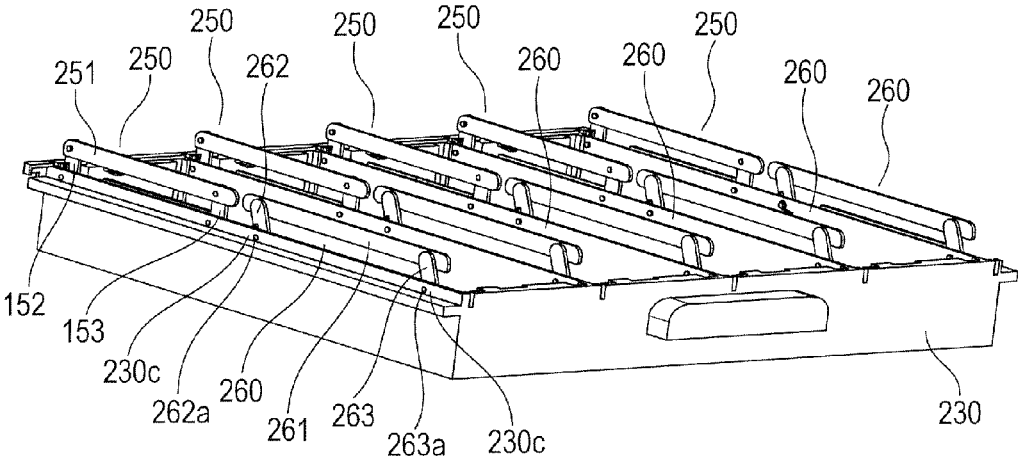
FIGS. 19A and 19B are each a perspective view for illustrating a pullout member according to a second embodiment.
Figure 19B:
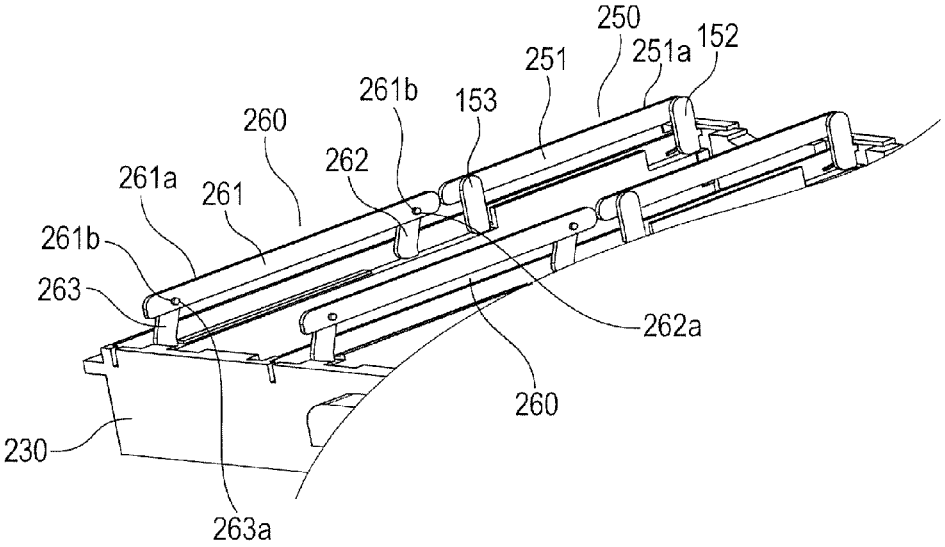

FIG. 19A and FIG. 19B are each a perspective view for illustrating the pullout member 230 according to the embodiment. As illustrated in FIG. 19B, the first protection portions 250 provided on the far side each include a four-bar parallel linkage formed of the first protection member 251, the first link member 152 on the far side, and the second link member 153 on the near side. The four-bar parallel linkage is different in configuration from the four-bar parallel linkage according to the first embodiment only in that one of the second link members 153 is omitted, and hence is not described in detail. Similarly, the configuration around the lock member 170 is the same as that of the first embodiment, and hence is not described in detail.

The second protection portions 260 provided on the near side each include a four-bar parallel linkage formed of the second protection member 261, a third link member 262 on the far side, and a fourth link member 263 on the near side. Link shafts 262*a* provided at both ends of the third link member 262 are engaged respectively with a link hole 261*b* of the second protection member 261 (see FIG. 19B) and a link hole 230*c* of the pullout member 230 (see FIG. 19A) in a freely pivotable manner. A distal end of each of the link shafts 262*a* is molten and flattened by the method such as heat staking to increase a shaft diameter thereof. In this way, retention of the link shafts 262*a* to the link holes 230*c* and 261*b* is performed.

Similarly, link shafts 263*a* provided at both ends of the fourth link member 263 are engaged respectively with another link hole 261*b* of the second protection member 261 and another link hole 230*c* of the pullout member 230 in a freely pivotable manner. A distal end of each of the link shafts 263*a* is molten and flattened by the method such as heat staking to increase a shaft diameter thereof. In this way, retention of the link shafts 263*a* to the other link holes 230*c* and 261*b* is performed.

Figure 20A:
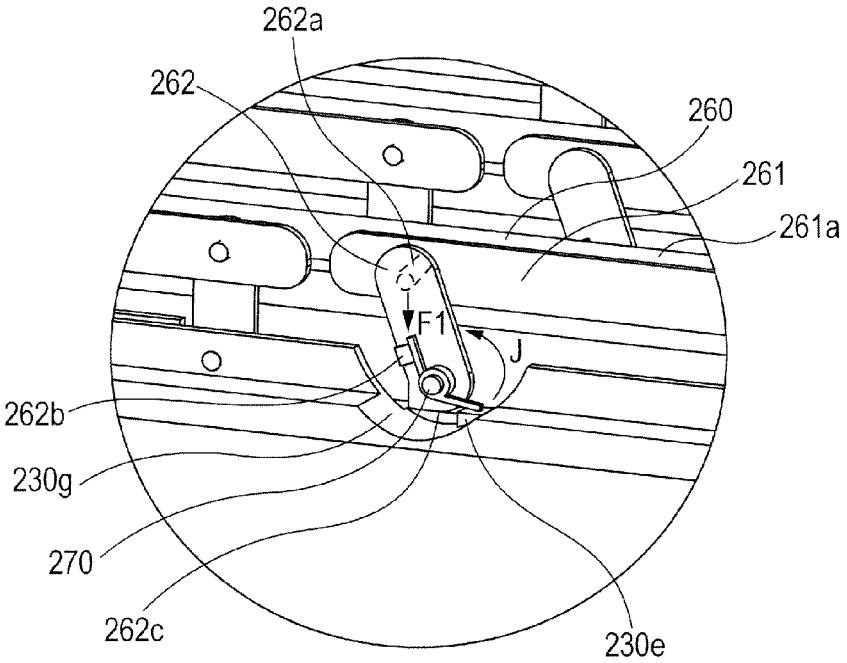
FIGS. 20A and 20B are each a perspective view for illustrating a protection portion according to the second embodiment.
Figure 20B:
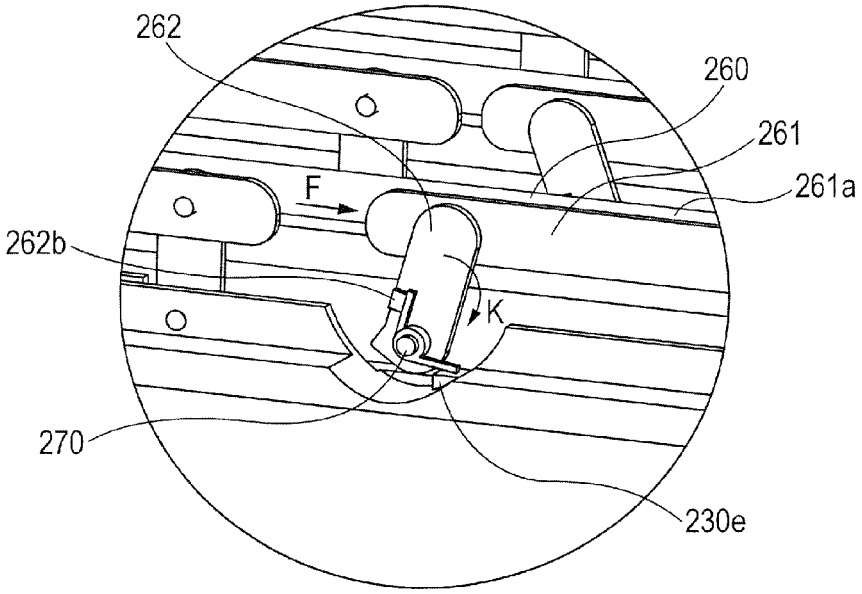

Further, a projecting portion 261*a* is provided along one end of the second protection member 261. Referring to FIG. 20A and FIG. 20B, a configuration around the third link member 262 will be described. In FIG. 20A and FIG. 20B, some of the components are cut out for the sake of simplicity of description.

As illustrated in FIG. 20A, a biasing member 270 (torsion spring) is provided on the link shaft 262*a* on a side on which the third link member 262 is supported by the pullout member 230. An arm at one end of the biasing member 270 is held in abutment against an engaging protrusion 262*b* of the third link member 262, and an arm at the other end thereof is held in abutment against an engaging protrusion 230*e* of the pullout member 230. With this, the third link member 262 is biased in a direction indicated by the arrow J in FIG. 20A. In the state of FIG. 20A, an abutment portion 262*c* of the third link member 262 and an abutment portion 230*g* of the pullout member 230 are held in abutment against each other. With this, the third link member 262 is stopped from being pivoted in the direction indicated by the arrow J in FIG. 20A.

Note that, as described in the first embodiment with reference to FIG. 14A and FIG. 14B, when the load of the foreign object 800 (not shown) is applied to the second protection portions 260, the force in the direction indicated by the arrow F1 in FIG. 20A is applied to the link shaft 262*a* at one end of the third link member 262 through intermediation of the second protection member 261. At this time, a moment in the direction indicated by the arrow J in FIG. 20A is applied about the link shaft 262*a* at the other end of the third link member 262. However, as described above, the abutment portion 262*c* of the third link member 262 and the abutment portion 230*g* of the pullout member 230 are held in abutment against each other. Thus, the third link member 262 is stopped from being pivoted in the direction indicated by the arrow J in FIG. 20A. The second protection portion 260 in this state is hereinafter described as "the second protection portion 260 is located at a protection position."

As illustrated in FIG. 20B, when the force in the direction indicated by the arrow F in FIG. 20B is applied to the second protection member 261, the third link member 262 is pivoted in a direction indicated by the arrow K in FIG. 20B against a biasing force of the biasing member 270. As described above, the second protection portion 260 includes the four-bar linkage. Thus, when the third link member 262 is pivoted in the direction indicated by the arrow K in FIG. 20B, the second protection member 261 is lowered.

(Protection of Drums at Pullout Position of Pullout Unit)

The pullout member 230 having the cartridges P mounted therein is referred to as a pullout unit U1. A projecting portion 251*a* of the first protection member 251 of each of the first protection portions 250, and the projecting portion 261*a* of the second protection member 261 of each of the second protection portions 260 are located above the surfaces of the drums 1. With this configuration, even when the foreign object 800 falls onto the pullout unit U1 in a state in which the pullout unit U1 is located at the pullout position, the foreign object 800 abuts against the projecting portions (upper ends) 251*a* of the first protection members 251 and the projecting portions (upper ends) 261*a* of the second protection members 261, which are located above the surfaces of the drums 1. With this, the foreign object 800 is prevented from falling onto the drums 1.

In this state, the first protection portions 250 and the second protection portions 260 are located at the protection positions, and hence the first and the second protection members 251 and 261 cannot be lowered (see FIG. 12 and FIG. 20A). Thus, even when the load of the foreign object 800 is applied to the first protection portions 250 and the second protection portions 260, the foreign object 800 can be reliably prevented from falling onto the drums 1. Therefore, the foreign object 800 does not abut against the drums 1, and hence does not damage the drums 1. With the configuration as described above, even when the foreign object 800 falls onto the pullout unit U1 at the pullout position, the drums 1 are prevented from being damaged. As a result, image defects that may be caused by the damage to the drums 1 can be prevented.

(Protection of Drums when Mounting Pullout Unit into Main Body)

In the operation of mounting the pullout unit U1 into the main body 100, in a state in which the pullout unit U1 is not fully mounted, the abutment protrusions 120 of the main body 100 (FIG. 15A and FIG. 15B) are held in abutment against the protection members 251 of the first protection portions 250, and the first protection members 251 are located at lowered positions. Meanwhile, the second protection portions 260 are located at the protection positions, and as described above, the projecting portion 261*a* (FIG. 20B) of each of the second protection members 261 is located above the surface of the drum 1. Thus, even when the foreign object 800 falls at a position at which the pullout unit U1 is not fully mounted, the drums 1 can be protected by the second protection members 261.

When the pullout unit U1 is moved further in the mounting direction, the abutment protrusions 120 of the main body 100 abut against the second protection members 261, and the third link members 262 are each pivoted in the direction indicated by the arrow K in FIG. 20B. With this, the second protection members 261 are each moved to a lowered position (see FIG. 20B). Then, in a state in which the pullout unit U1 is mounted up to the mounting position, the abutment protrusions 120 of the main body 100 are held in abutment against the first protection members 251 and the second protection members 261. With this, the first protection members 251 and the second protection members 261 are held at the lowered positions. Note that, the abutment protrusions 120 of the main body 100 are extended toward the far side of the main body 100 so as to be continuously held in abutment against the projecting portions 251*a* of the first protection members 251.

As described above, according to the holding mechanism of the embodiment, when the moving member is moved between the inside position and the outside position, the protection members are held at the positions vertically above the surfaces of the image bearing members, and when the moving member is located at the inside position so that the image formation is performed, the protection members are held at the positions vertically below the surfaces of the image bearing members. With this, according to the embodiment, the surfaces of the drums 1 can be protected when the pullout member is pulled out within the small space.

Further, according to the embodiment, even when the pullout unit is not fully mounted, the protection members provided on the far side are lowered without lowering the protection members on the near side. With this, the drums 1 can be protected from the foreign object 800 that may fall thereonto.

Third Embodiment

Next, a third embodiment of the present invention will be described. In the embodiment, the protection portions each include a color distinguishing portion so that mounting positions of the cartridges P can be clearly distinguished from each other (can be grasped by sight) by their respective colors (developing colors). Note that, the same parts as those in the configurations of the main body and the cartridges according to the first embodiment are not described in detail.

Figure 21:
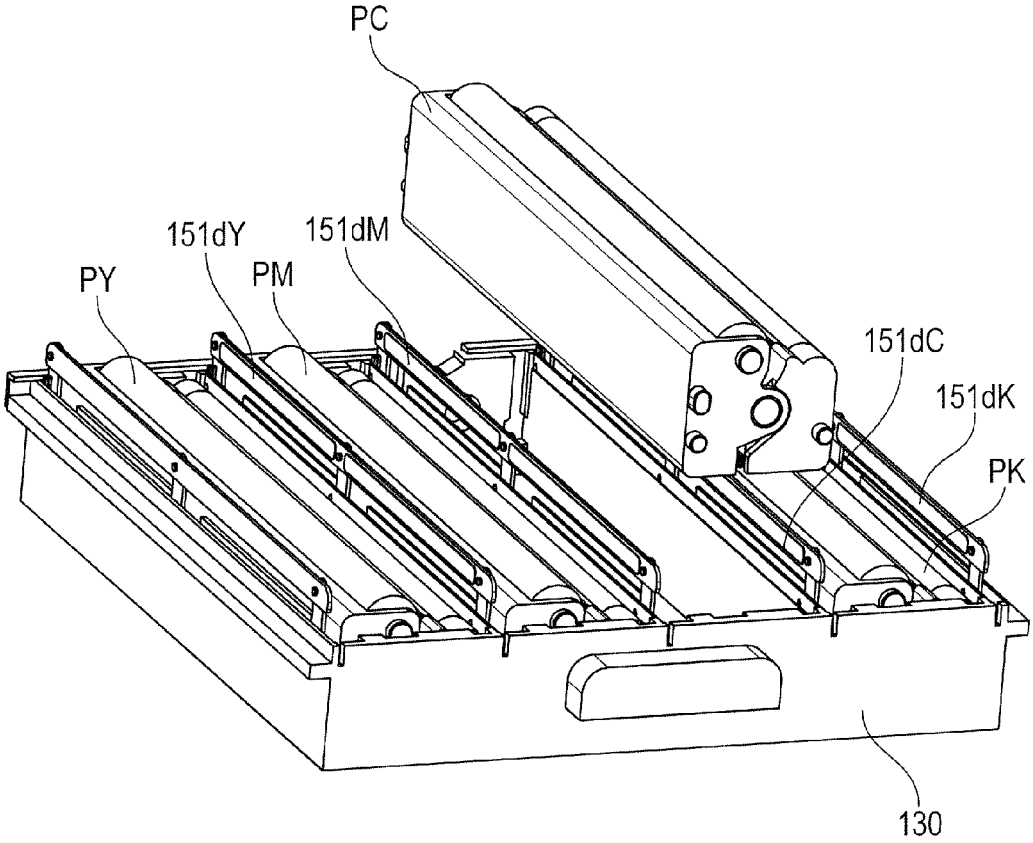
FIG. 21 is a perspective view for illustrating a pullout member according to a third embodiment.

As illustrated in FIG. 21, correspondingly to the developing color (such as cyan) of the cartridge P to be mounted, a color distinguishing portion 151*d*C is provided on the protection portion 150. Similarly, color distinguishing portions 151*d*Y, 151*d*M, and 151*d*K are provided for yellow, magenta, and black, respectively. Note that, the color distinguishing portions 151*d* (Y, M, C, and K) are each provided to face the cartridges P to be mounted on both sides thereof. Note that, as other examples of the color distinguishing portions 151*d*, the color distinguishing portions 151*d* may be colored with colors that are the same as or similar to the developing colors, or names of the developing colors: yellow, magenta, cyan, and black may be indicated.

As described above, with the holding mechanism according to the embodiment, when the moving member is moved between the inside position and the outside position, the protection members are held at the positions vertically above the surfaces of the image bearing members, and when the moving member is located at the inside position so that the image formation is performed, the protection members are held at the positions vertically below the surfaces of the image bearing members. With this, according to the embodiment, the surfaces of the drums 1 can be protected when the pullout member is pulled out within the small space.

Further, according to the embodiment, the color distinguishing portions 151*d* (Y, M, C, and K) allow the mounting positions of the cartridges P of the respective developing colors to be clearly grasped by sight. Thus, the cartridges P can be prevented from being misplaced.

Fourth Embodiment

Next, a fourth embodiment of the present invention will be described. In the embodiments described above, the protection members are moved so that positions of the protection members and the drums vary relative to each other. Meanwhile, in the embodiment, the cartridges including the drums are moved in upper and lower directions with respect to the pullout member so that the positions of the protection members and the drums vary relative to each other.

Specifically, the main body includes a raising and lowering member configured to raise and lower the cartridges with respect to the pullout member in conjunction with opening and closing of the door 10 (FIG. 2B) so that height positions (in the vertical direction) of the drums can be changed. Then, the image bearing member units (FIG. 23A) below projecting portions (upper end portions) 330*h* of protection members 330*g* are displaced integrally above the projecting portions (upper end portions) 330*h* by the raising and lowering member to prepare for image formation (FIG. 23B).

Now, referring to FIG. 22A and FIG. 22B, a pullout member 330 according to the embodiment will be described. Note that, the same parts as those in the configurations of the main body and the cartridges according to the first embodiment are not described in detail.

Figure 22A:
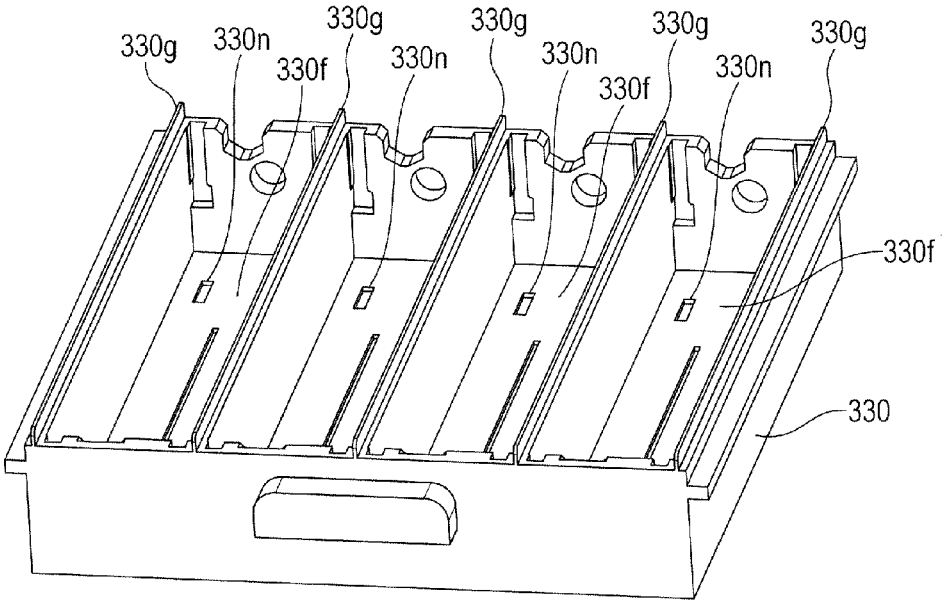
FIGS. 22A and 22B are each a perspective view for illustrating a pullout member according to a fourth embodiment.
Figure 22B:
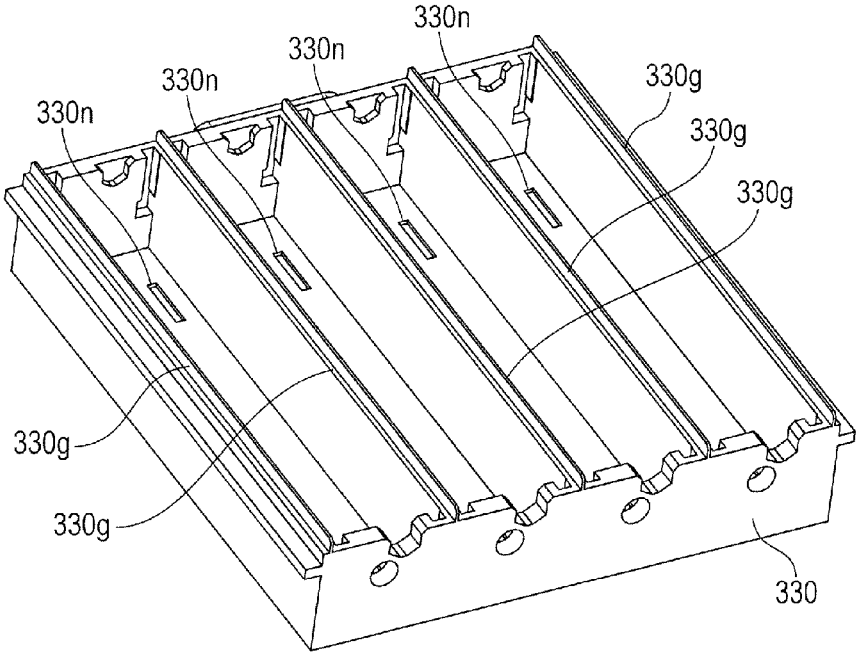

In the pullout member 330, the protection members 330*g* are provided on both sides in a transverse direction of each of mounting portions 330*f* for mounting the cartridges P (FIG. 22A). Further, a depth of each of the mounting portions 330*f* is set to be larger than that of the mounting portion 130*f* described in the first embodiment, and a cam opening 330*n* is formed. Further, when the cartridges P are mounted into the mounting portions 330*f* of the pullout member 330, the surfaces of the drums 1 are located vertically below the projecting portions (upper end portions) 330*h* of the protection members 330*g* (FIG. 23A).

Thus, even when the foreign object 800 (FIG. 14A and FIG. 14B) falls onto the pullout unit, the foreign object 800 abuts against the projecting portions (upper end portions) 330*h* of the protection members 330*g*, and is prevented from falling onto the drums 1. Thus, the foreign object 800 does not abut against the drums 1, and hence the drums 1 are not damaged. As a result, image defects that may be caused by the damage to the drums 1 can be prevented.

(Mounting of Pullout Unit into Main Body)

Figure 23A:
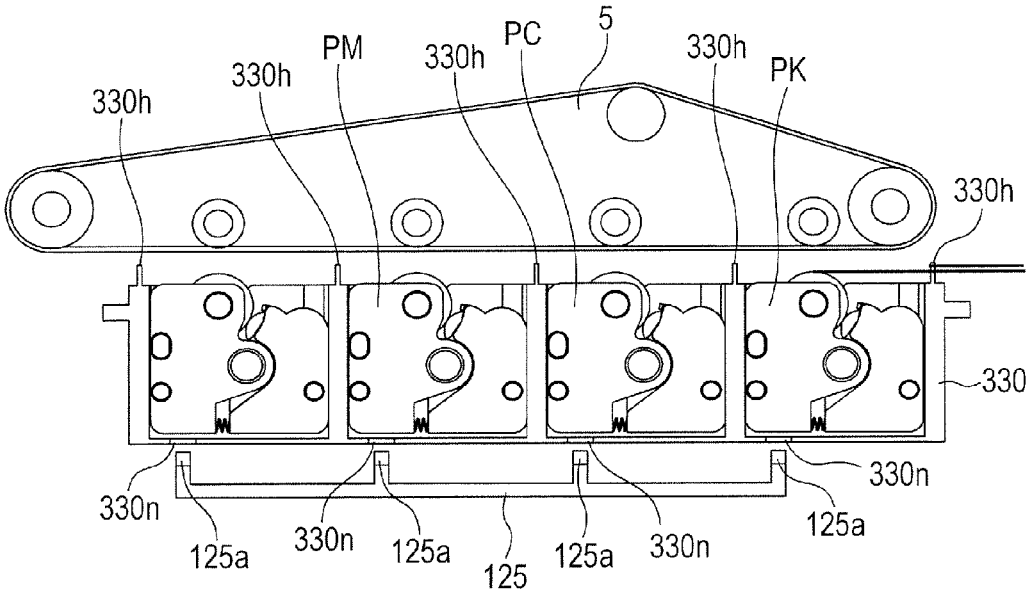
FIGS. 23A and 23B are each an explanatory view for illustrating how the pullout member according to the fourth embodiment is mounted.
Figure 23B:
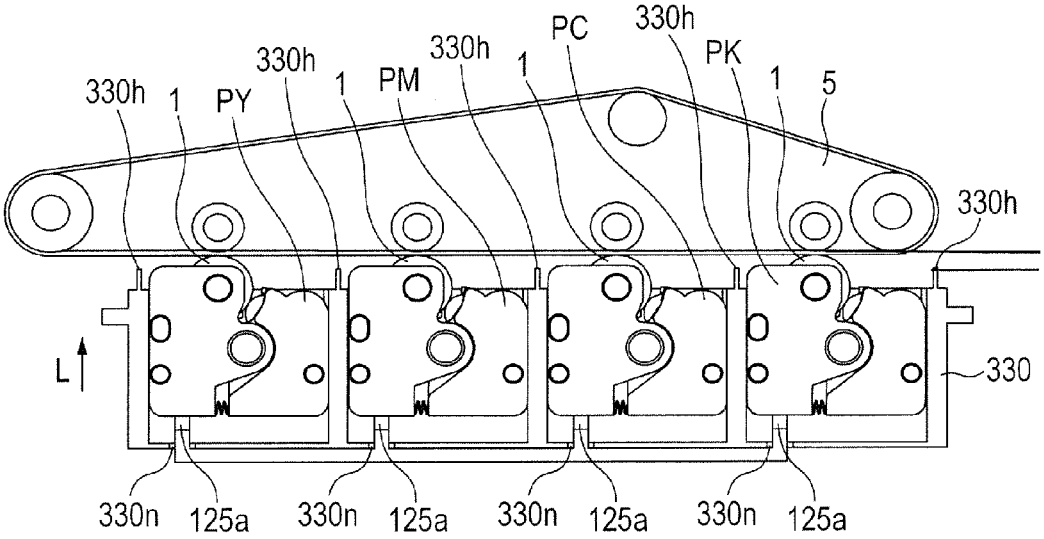

Referring to FIG. 23A and FIG. 23B, how the pullout unit is mounted into the main body 100 will be described. In the embodiment, as illustrated in FIG. 23A and FIG. 23B, in the main body 100, a raising and lowering member 125 including cam portions 125*a* are configured to be raised and lowered in upper and lower directions in FIG. 23A and FIG. 23B. Note that, for the sake of simplicity of description, some of the components are cut out or not illustrated.

FIG. 23A is a view for illustrating a state in which the pullout unit is mounted to the mounting position in the main body 100, and the door 10 (FIG. 2B) is opened. The raising and lowering member 125 is located at a lowered position, and the cartridges P are located on a lower side in the pullout member 330. FIG. 23B is a view for illustrating a state in which the door 10 (FIG. 2B) in the state of FIG. 23A is closed.

In FIG. 23B, first, in conjunction with the operation of closing the door 10, the raising and lowering member 125 (holding mechanism) is raised by a mechanism (not shown) in a direction indicated by the arrow L in FIG. 23B (vertically upward). In conjunction therewith, the cam portions 125*a* are raised to pass through the cam openings 330*n* (FIG. 22A, FIG. 22B, FIG. 23A, and FIG. 23B) of the pullout member 330 so that the cartridges P are moved upward with respect to the pullout member 330. With this, the cartridges P abut against positioning portions (not shown) provided in the main body 100, and the surfaces of the drums 1 are moved above the projecting portions 330*h* of the protection members 330*g*. As a result, the drums 1 abut against a transfer member 5. During the image formation, the cartridges P are held in this state by the raising and lowering member 125.

Further, in conjunction with the operation of closing the door 10 (FIG. 2B) in the latter half stage, both the drum coupling members 25 and the development coupling members 26 (see FIG. 3) move into the pullout member 330. In this way, the cartridges P received in the pullout member 330 are positioned in the main body 100. At this time, the projecting portions (upper end portions) 330*h* of the protection members 330*g* are located vertically below the surfaces of the drums 1, and hence the projecting portions (upper end portions) 330*h* of the protection members 330*g* do not interfere with the transfer member 5.

As described above, according to the holding mechanism of the embodiment, the image bearing member units are moved with respect to the moving member. The holding mechanism is configured to move the image bearing member units so as to change the height positions of the image bearing members. Specifically, when the moving member is moved between the inside position and the outside position, the holding mechanism holds the image bearing members at the positions vertically below the protection members. Meanwhile, when the moving member is located at the inside position so that the image formation is performed, the image bearing member units are raised so that the surfaces of the image bearing members are held at the positions vertically above the protection members. With this, according to the embodiment, the surfaces of the drums 1 can be protected when the pullout member is pulled out within the small space.

Fifth Embodiment

Figure 24:
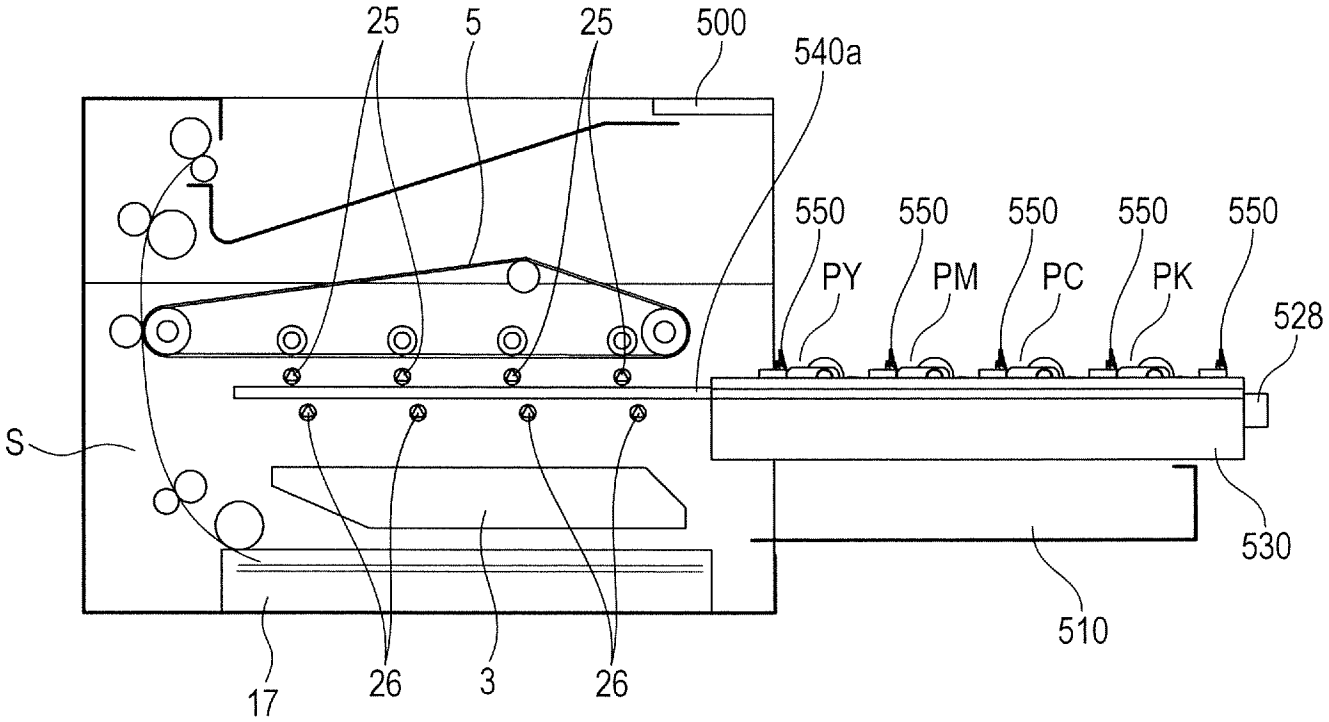
FIG. 24 is a sectional view for illustrating a main body of an image forming apparatus according to a fifth embodiment.

Next, a fifth embodiment of the present invention will be described. In the embodiments described above, the pullout member is pulled out in the direction orthogonal to the conveying direction of the sheet material S. However, in the embodiment, as illustrated in FIG. 24, the pullout member is pulled out in a direction parallel to the conveying direction of the sheet material S. Further, in the embodiment described above, the raising and lowering member is used to raise and lower the protection members provided on the pullout member so as to change the height positions of the protection members. However, in the embodiment, the protection members are pivoted to change the height positions of the protection members provided on the pullout member. Note that, in the embodiment, the same parts as those in the configurations of the main body and the cartridges according to the first embodiment are not described in detail.

Figure 25A:
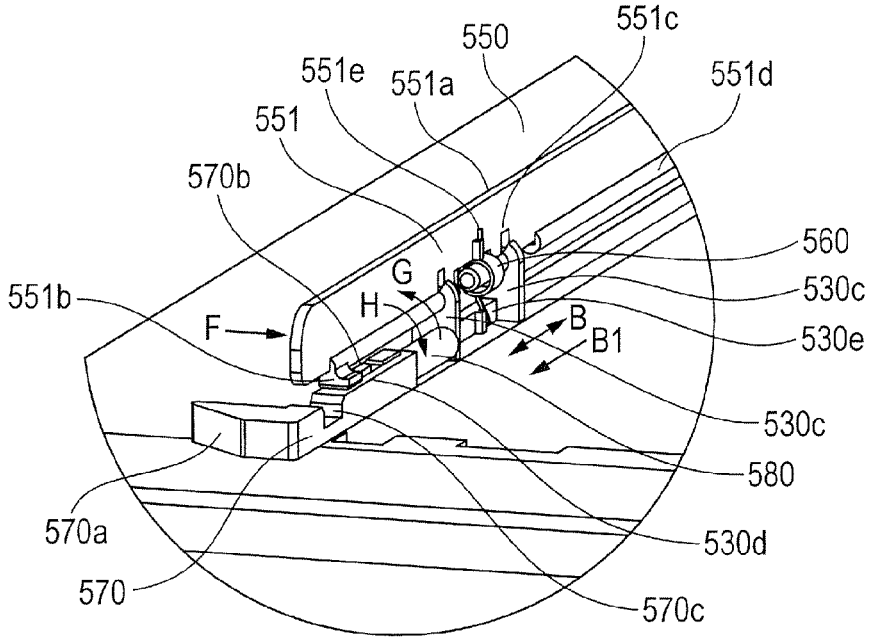
FIGS. 25A and 25B are each a perspective view for illustrating a protection portion according to the fifth embodiment.
Figure 25B:
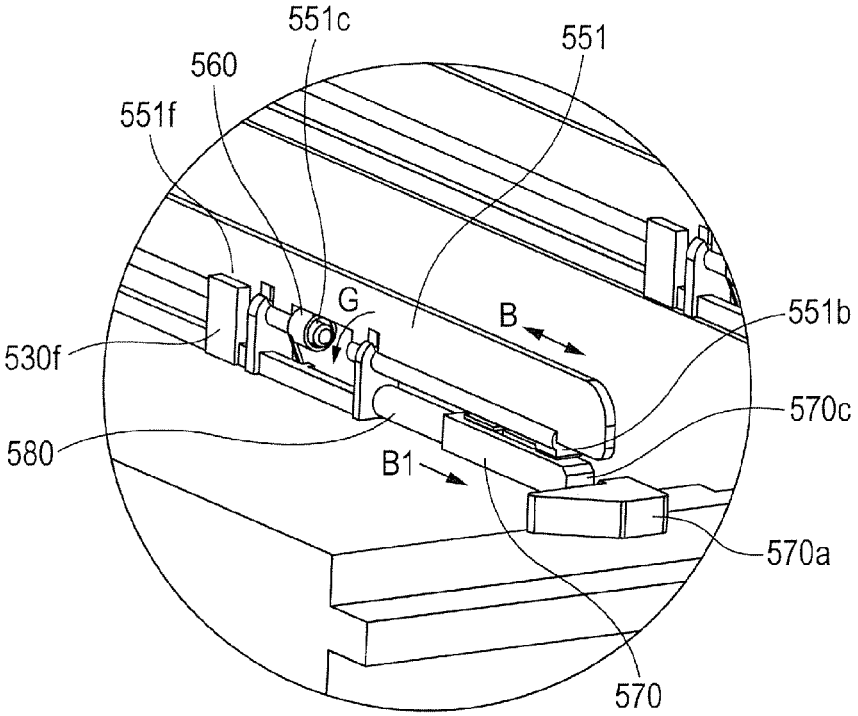

Referring to FIG. 25A, FIG. 25B, FIG. 26A, and FIG. 26B, protection portions 550 provided on a pullout member 530 and configurations therearound will be described. The protection portions 550 each include a protection member 551 and a lock member 570 that are illustrated in FIG. 25A and FIG. 25B. Further, the lock member 570 includes an abutment portion 570*a*, an engagement hole 570*b* formed to have a clearance in the direction indicated by the arrow B in FIG. 25A and FIG. 25B, and a cutout portion 570*c*.

A fixing rib 530*d* provided on the pullout member 530 is inserted through the engagement hole 570*b*. The lock member 570 is fixed to be movable in the direction indicated by the arrow B in FIG. 25A and FIG. 25B. Further, the lock member 570 is biased in the direction indicated by the arrow B1 in FIG. 25A and FIG. 25B by a biasing member 580. Note that, a distal end of the fixing rib 530*d* is expanded by being molten and flattened by the method such as heat staking. In this way, retention of the fixing rib 530*d* to the engagement hole 570*b* is performed.

Further, a pivot shaft 551*d* of the protection member 551 is fixed in a freely pivotable manner to support ribs 530*c* provided at three positions on the pullout member 530. Still further, a projecting portion 551*a* is formed along one end (upper end portion) of the protection member 551.

In addition, a fixing portion 551*c* is provided coaxially with the pivot shaft 551*d* of the protection member 551, and a biasing member 560 (torsion spring) is provided thereon. An arm at one end of the biasing member 560 is held in abutment against an abutment portion 551*e* of the protection member 551, and an arm at the other end thereof is held in abutment against an abutment portion 530*e* of the pullout member 530. With this, the protection member 551 is biased in the direction indicated by the arrow G in FIG. 25A and FIG. 25B. Further, in a state in which the force in the direction indicated by the arrow F illustrated in FIG. 25A has not yet been applied, an abutment portion 551*f* of the protection member 551 and an abutment rib 530*f* of the pullout member 530 are held in abutment against each other. With this, the protection member 551 is stopped from being pivoted in the direction indicated by the arrow G in FIG. 25A.

Note that, a lock claw 551*b* of the protection member 551 is held in abutment against the lock member 570. Thus, even when the force in the direction indicated by the arrow F illustrated in FIG. 25A is applied to the protection member 551, the protection member 551 is prevented from pivoting in the direction indicated by the arrow H in FIG. 25A. The protection portion 550 in this state is hereinafter described as "the protection portion 550 is located at the protection position."

(Protection of Drums at Pullout Position)

At the pullout position, the projecting portions 551*a* of the protection members 551 are located vertically above the surfaces of the drums 1. With this configuration, even when the foreign object 800 falls onto the pullout unit in the state in which the pullout unit is located at the pullout position, the foreign object 800 abuts against the projecting portions 551*a* of the protection members 551, and is prevented from falling onto the drums 1. In this state, the protection portions 550 are located at the protection positions, and hence the protection members 551 cannot be pivoted. Thus, even when the load of the foreign object 800 is applied to the protection portions 550, the foreign object 800 can be reliably prevented from falling onto the drums 1. Therefore, the foreign object 800 does not abut against the drums 1, and hence does not damage the drums 1.

In this way, with this configuration, even when the foreign object 800 falls onto the pullout unit at the pullout position, the drums 1 are prevented from being damaged. As a result, image defects that may be caused by the damage to the drums 1 can be prevented.

(Mounting of Pullout Unit into Main Body)

Figure 26A:
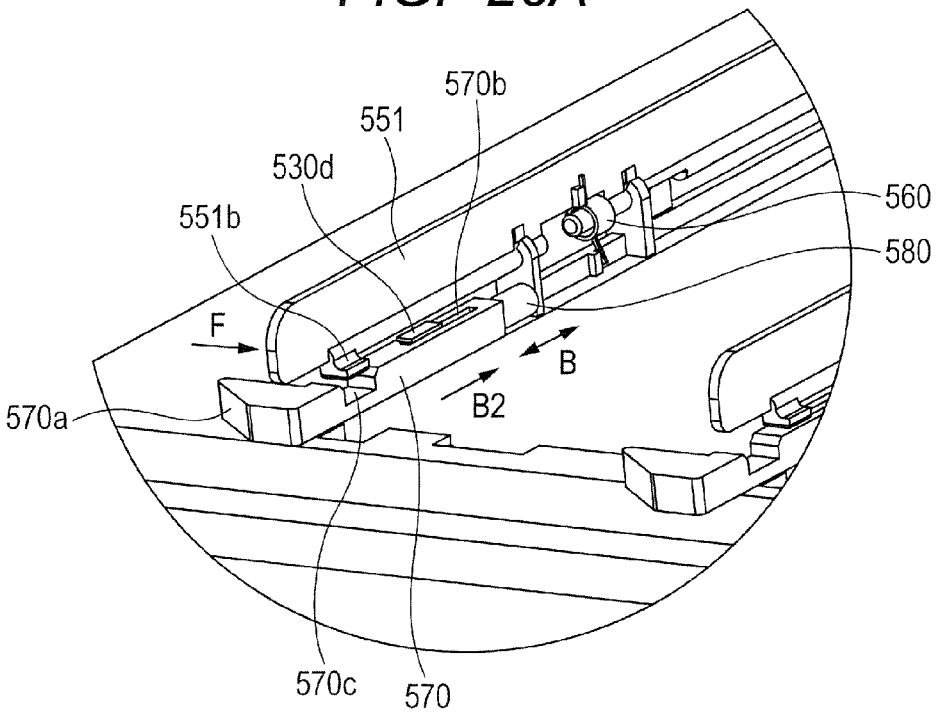
FIGS. 26A and 26B are each a perspective view for illustrating the protection portion according to the fifth embodiment.
Figure 26B:
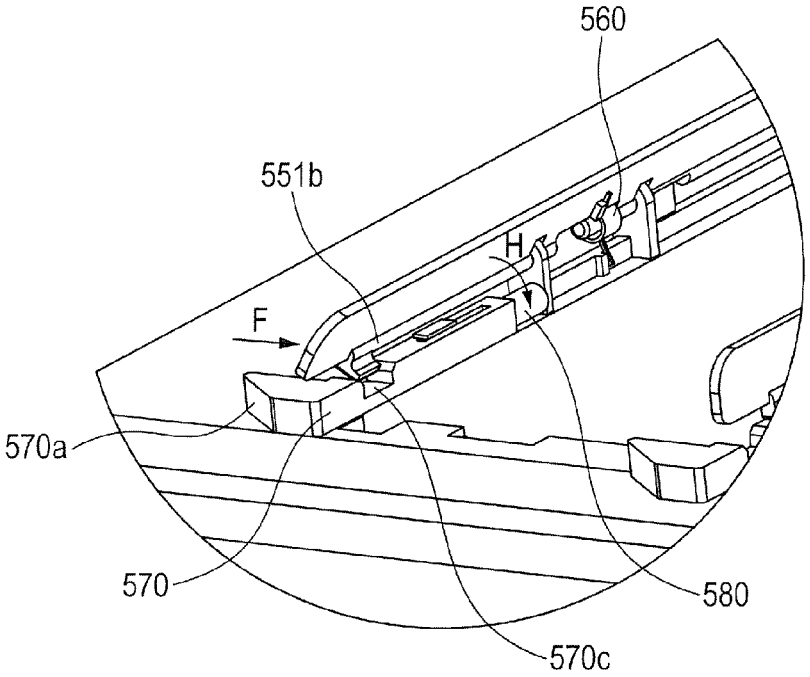

Next, referring to FIG. 26A, FIG. 26B, and FIG. 27, an operation of mounting the pullout unit into a main body 500 will be described. Guided portions of the pullout member 530 are guided respectively along guiding grooves of the main body 500. With this, the pullout member 530 is mounted into the main body 500. Note that, at the pullout position, the lock member 570 is shifted in the direction indicated by the arrow B1 in FIG. 25A and FIG. 25B, and hence the protection member 551 cannot be pivoted. In other words, the protection portion 550 is held at the protection position.

Then, when the pullout unit is moved further in the mounting direction, the abutment portion 570*a* of the lock member 570 abuts against a lock abutment portion 541*b* of the main body 500. With this, the lock member 570 is moved in the direction indicated by the arrow B2 (FIG. 26A). At this time, the cutout portion 570*c* of the lock member 570 and the lock claw 551*b* of the protection member 551 are positionally aligned with each other in the direction indicated by the arrow B in FIG. 26A.

Figure 27:
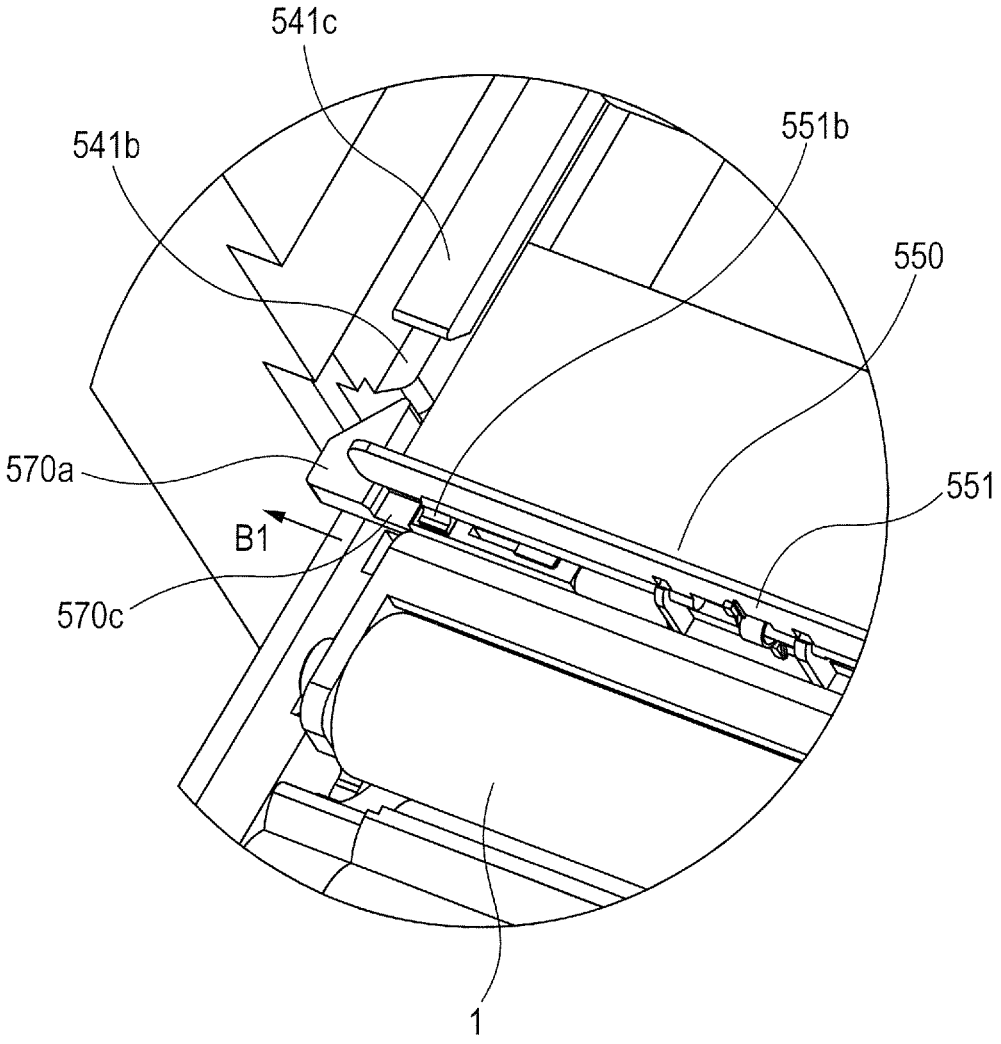
FIG. 27 is an explanatory view for illustrating how a pullout member according to the fifth embodiment is mounted.

When the pullout unit is moved still further in the mounting direction, as illustrated in FIG. 27, an abutment protrusion 541*c* (provided at a position on the far side with respect to the lock abutment portion 541*b*) of the main body 500 abuts against the protection member 551 of the protection portion 550. With this, the abutment protrusion 541*c* of the main body 500 applies the force in the direction indicated by the arrow F in FIG. 26B. As a result, the lock claw 551*b* of the protection member 551 passes through the cutout portion 570*c* of the lock member 570, and the protection member 551 is pivoted in the direction indicated by the arrow H (FIG. 26B). When the pullout unit is moved yet further in the mounting direction, the abutment protrusion 541*c* of the main body 500 abuts against all the protection members 551 sequentially from the protection member 551 on the far side. With this, all the protection members 551 are pivoted.

In this state, the projecting portions 551*a* of the protection members 551 are located vertically below the surfaces of the drums 1, and hence the projecting portions 551*a* of the protection members 551 do not interfere with the transfer member 5.

Further, in the configuration according to the embodiment, in the operation of opening the door 10, the transfer member 5 is retracted from the image formation position (not shown). Thus, during the operation of moving the pullout unit to the mounting position, the surfaces of the drums 1 and the surface of the transfer member 5 are not rubbed against each other.

Meanwhile, through the operation of closing the door 10, both the drum coupling members 25 and the development coupling members 26 (see FIG. 24) move into the pullout member 530. Moreover, the transfer member 5 is lowered in conjunction with the door 10. In this way, the cartridges P received in the pullout member 530 are positioned in the main body 500.

As described above, according to the holding mechanism of the embodiment, when the moving member is moved between the inside position and the outside position, the protection members are held at the positions vertically above the surfaces of the image bearing members, and when the moving member is located at the inside position so that the image formation is performed, the protection members are held at the positions vertically below the surfaces of the image bearing members. With this, according to the embodiment, the surfaces of the drums 1 can be protected when the pullout member 530 is pulled out within the small space.

Modification

The exemplary embodiments of the present invention are described above, but the present invention is not limited to the embodiments and can be modified and changed variously within the scope of the gist thereof.

(First Modification)

In the embodiments described above, when the pullout member is located at the outside position located outside of the main body, the image bearing member units and the developing units can be integrally mounted into and removed from the pullout member as the cartridges (process cartridges). However, the present invention is not limited thereto. Specifically, this configuration may be applicable also to an image forming apparatus in which those units are not integrated into cartridges, or to an image forming apparatus in which, of the image bearing member units and the developing units, only the developing units can be mounted into and removed from the pullout member as cartridges.

(Second Modification)

In the embodiments described above, the toner image (developer image) on the photosensitive drum 1 is primarily transferred onto the transfer member 5 as the transferred member by the primary transfer roller 12 as the transfer member, and then transferred onto the recording medium (sheet material S) as the transferred material by the secondary transfer roller 29. However, the present invention is not limited thereto, and this configuration may be applicable also to an image forming apparatus of a direct transfer type, in which the toner image (developer image) on the photosensitive drum 1 is transferred directly onto the recording medium (sheet material S) as the transferred material by the primary transfer roller 12 as the transfer member.

(Third Modification)

In the embodiments described above, through the mounting operation, the projection portions of the protection members are displaced from the positions vertically above the surfaces of the drums 1 to the positions vertically below the surfaces thereof by the holding mechanism. However, the displacement may be interlocked with opening and closing of the door configured to open and close the opening portion of the main body. Specifically, when the door is closed, in conjunction therewith, the projection portions of the protection members can be displaced from the positions vertically above the surfaces of the drums 1 to the positions vertically below the surfaces thereof.

(Fourth Modification)

In the embodiments described above, the holding mechanism including the first link members 152, the second link members 153, the biasing member 160, and the lock member 170 is provided for each of the sets of the image bearing member unit and the developer carrying member unit. However, the holding mechanism may be provided in common among the sets.

Lastly, advantages of the embodiments and the modifications described above can be summarized as follows. According to the configurations described above, the image bearing members can be protected while suppressing an increase in cost or size of the cartridges.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-123276, filed Jun. 16, 2014, which is hereby incorporated by reference herein in its entirety.

What is claimed is:

1. An image forming apparatus, comprising:

an image bearing member;

a developer carrying member configured to form a developer image on the image bearing member;

a moving member movable between an inside position located inside of a main body of the image forming apparatus and an outside position located outside of the main body in a state of supporting the image bearing member and the developer carrying member, the moving member comprising a mounting portion on which a cartridge is mounted and an exposing portion exposing the image bearing member vertically upward, the cartridge being mountable on and removable from the mounting portion when the moving member is located at the outside position;

a transfer member configured to contact the image bearing member at a time of an image formation;

a protection member provided on the moving member and configured to protect a surface of the image bearing member; and a holding mechanism configured to hold the protection member at a first position at which the protection member protrudes above a portion of the image bearing member exposed at the exposing portion when the moving member is located at the outside position, and to hold the protection member at a second position at which the protection member is located below the transfer member when the moving member is located at the inside position.

2. An image forming apparatus according to claim 1, wherein the protection member has a plate shape, and wherein the holding mechanism comprises a link member provided on the moving member and coupled to the protection member so that the protection member is movable with respect to the moving member.

3. An image forming apparatus according to claim 1, further comprising a door provided on the main body and configured to open and close an opening portion through which the moving member is moved, wherein the holding mechanism interlocks with opening and closing of the door, and wherein, when the door is closed, the holding mechanism displaces the protection member from the first position to the second position and holds the protection member at the second position.

4. An image forming apparatus according to claim 3, wherein contact and separation of the image bearing member and the transfer member interlock with the opening and closing of the door so that the image bearing member and the transfer member are separated from each other when the door is opened.

5. An image forming apparatus according to claim 1, wherein the protection member is integrally provided on the moving member along a moving direction of the moving member.

6. An image forming apparatus according to claim 1, wherein the protection member comprises a plurality of separate protection members each provided on the moving member along a moving direction of the moving member.

7. An image forming apparatus according to claim 1, wherein the moving member supports a plurality of sets each comprising the image bearing member and the developer carrying member, and wherein the protection member is provided for each of the plurality of sets.

8. An image forming apparatus according to claim 7, wherein the plurality of sets are provided for different colors, and wherein the protection member comprises a color distinguishing portion configured to distinguish a corresponding color from the different colors.

9. An image forming apparatus according to claim 7, wherein the holding mechanism is provided for each of the plurality of sets.

10. An image forming apparatus according to claim 7, wherein the holding mechanism is provided for the plurality of sets in common.

11. An image forming apparatus according to claim 1, wherein the holding mechanism comprises a raising and lowering member configured to raise and lower the protection member so as to change a height position of the protection member.

12. An image forming apparatus according to claim 1, wherein the holding mechanism comprises a pivotal movement unit configured to pivot the protection member so as to change a height position of the protection member.

13. An image forming apparatus according to claim 1, wherein the holding mechanism moves the image bearing member with respect to the moving member so as to change a height position of the image bearing member.

14. An image forming apparatus according to claim 1, wherein the cartridge comprises at least one of the image bearing member and the developer carrying member.

15. An image forming apparatus according to claim 14, wherein the protection member is provided on each of both end portions of an opening portion through which the cartridge is mounted on the moving member.

16. An image forming apparatus according to claim 1, further comprising an exposure unit provided vertically below the image bearing member and configured to form an electrostatic latent image on the image bearing member.

17. A moving member configured to support an image bearing member and a developer carrying member, the moving member being movable between an inside position located inside of a main body of an image forming apparatus and an outside position located outside of the main body, wherein the image bearing member supported by the moving member is exposed vertically upward when the moving member is located at the outside position, the moving member comprising:

a mounting portion on which a cartridge is mountable, wherein the cartridge is mountable on the mounting portion when the moving member is located at the outside position;

an exposing portion exposing the image bearing member vertically upward;

a protection member provided on the moving member and configured to protect a surface of the image bearing member; and a holding mechanism configured to hold the protection member at a first position at which the protection member protrudes above a portion of the image bearing member exposed from the exposing portion when the moving member is located at the outside position, and to hold the protection member at a second position at which the protection member is not disposed above the portion of the image bearing member exposed from the exposing portion when the moving member is located at the inside position.

18. A moving member according to claim 17, wherein the protection member has a plate shape, and wherein the holding mechanism comprises a link member provided on the moving member and coupled to the protection member so that the protection member is movable with respect to the moving member.

19. A moving member according to claim 17, wherein the protection member is integrally provided on the moving member along a moving direction of the moving member.

20. A moving member according to claim 17, wherein the protection member comprises a plurality of separate protection members each provided on the moving member along a moving direction of the moving member.

21. A moving member according to claim 17, wherein the moving member supports a plurality of sets each comprising the image bearing member and the developer carrying member, and wherein the protection member is provided for each of the plurality of sets.

22. A moving member according to claim 21, wherein the plurality of sets are provided for different colors, and wherein the protection member comprises a color distinguishing portion configured to distinguish a corresponding color from the different colors.

23. A moving member according to claim 21, wherein the holding mechanism is provided for each of the plurality of sets.

24. A moving member according to claim 21, wherein the holding mechanism is provided for the plurality of sets in common.

25. A moving member according to claim 17, wherein the holding mechanism comprises a raising and lowering member configured to raise and lower the protection member so as to change a height position of the protection member.

26. A moving member according to claim 17, wherein the holding mechanism comprises a pivotal movement unit configured to pivot the protection member so as to change a height position of the protection member.

27. A moving member according to claim 17, wherein the cartridge comprises at least one of the image bearing member and the developer carrying member.

28. A moving member according to claim 27, wherein the protection member is provided on each of both end portions of an opening portion through which the cartridge is mounted on the moving member.

* * * * *